US005187745A

United States Patent [19]

Yip et al.

[11] Patent Number: 5,187,745

[45] Date of Patent: Feb. 16, 1993

[54] EFFICIENT CODEBOOK SEARCH FOR CELP VOCODERS

[75] Inventors: William C. Yip; David L. Barron, both of Scottsdale, Ariz.

[73] Assignee: Motorola, Inc., Schaumburg, Ill.

[21] Appl. No.: 722,572

[22] Filed: Jun. 27, 1991

[51] Int. Cl.[5] ..... G10L 5/00

[52] U.S. Cl. ..... 381/36; 381/40

[58] Field of Search ..... 381/29–40

[56] References Cited

U.S. PATENT DOCUMENTS 4,910,781 3/1990 Ketchum et al. ..... 381/36

OTHER PUBLICATIONS

Trancoso et al., "Efficient Procedures for Finding the Optimum Innovation etc.," ICASSP 86, Tokyo, IEEE, 1986, pp. 2375–2378.

*Primary Examiner*—Emanuel S. Kemeny

*Attorney, Agent, or Firm*—Robert M. Handy

[57] ABSTRACT

A new way of determining correlation coefficients for stochastic codebook vectors for CELP coding of speech takes advantage of the sparsely populated nature of stochastic codebook vectors. N valued input signals (e.g., convolution vectors) to be correlated with N valued codebook vectors are fed to an N by N multiplexer or other selection means and the signal values either passed to an accumulator or not according to the state of N select inputs or other identification means determined from a memory store (e.g., an EPROM) whose entries correspond to the non-zero values of the codebook vectors. The accumulator output is the correlation of the codebook vector with the input signal. A sequencer steps through the entire codebook to provide correlation values for each vectors. The results are used to determine the optimum stochastic codebook vector for replicating the particular speech frame being analyzed.

18 Claims, 7 Drawing Sheets

| k \ n | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 1 | 0 | 0 | 0 | -1 | -1 | 0 | 0 | 0 | -1 | 0 | 0 | 0 | 0 | 1 | 0 | 0 | 0 | -1 | 1 | 0 |
| 2 | 0 | 1 | -1 | 0 | 0 | 0 | -1 | 0 | 0 | 0 | 0 | 1 | 0 | 0 | 0 | -1 | 1 | 0 | 0 | 0 |
| 3 | -1 | 0 | 0 | 0 | -1 | 0 | 0 | 0 | 0 | 1 | 0 | 0 | 0 | -1 | 1 | 0 | 0 | 0 | 0 | 1 |
| 4 | 0 | 0 | -1 | 0 | 0 | 0 | 0 | 1 | 0 | 0 | 0 | -1 | 1 | 0 | 0 | 0 | 0 | 1 | -1 | 0 |
| 5 | -1 | 0 | 0 | 0 | 0 | 1 | 0 | 0 | 0 | -1 | 1 | 0 | 0 | 0 | 0 | 1 | -1 | 0 | 0 | 0 |
| 6 | 0 | 0 | 0 | 1 | 0 | 0 | 0 | -1 | 1 | 0 | 0 | 0 | 0 | 1 | -1 | 0 | 0 | 0 | -1 | 0 |
| 7 | 0 | 1 | 0 | 0 | 0 | -1 | 1 | 0 | 0 | 0 | 0 | 1 | -1 | 0 | 0 | 0 | -1 | 0 | 0 | 0 |
| 8 | 0 | 0 | 0 | -1 | 1 | 0 | 0 | 0 | 0 | 1 | -1 | 0 | 0 | 0 | -1 | 0 | 0 | 0 | 0 | 1 |

180'

FIG. 6

| k \ n | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 1 | 0 | 0 | 0 | 1 | 0 | 0 | 0 | 0 | 0 | 0 | 0 | 0 | 0 | 1 | 0 | 0 | 0 | 0 | 1 | 0 |
| 2 | 0 | 1 | 0 | 0 | 0 | 0 | 0 | 0 | 0 | 0 | 0 | 1 | 0 | 0 | 0 | 0 | 1 | 0 | 0 | 0 |
| 3 | 0 | 0 | 0 | 0 | 0 | 0 | 0 | 0 | 0 | 1 | 0 | 0 | 0 | 0 | 1 | 0 | 0 | 0 | 0 | 1 |
| 4 | 0 | 0 | 0 | 0 | 0 | 0 | 0 | 1 | 0 | 0 | 0 | 0 | 1 | 0 | 0 | 0 | 0 | 1 | 0 | 0 |
| 5 | 0 | 0 | 0 | 0 | 0 | 1 | 0 | 0 | 0 | 0 | 1 | 0 | 0 | 0 | 0 | 1 | 0 | 0 | 0 | 0 |
| 6 | 0 | 0 | 0 | 1 | 0 | 0 | 0 | 0 | 1 | 0 | 0 | 0 | 0 | 1 | 0 | 0 | 0 | 0 | 0 | 0 |
| 7 | 0 | 1 | 0 | 0 | 0 | 0 | 1 | 0 | 0 | 0 | 0 | 1 | 0 | 0 | 0 | 0 | 0 | 0 | 0 | 0 |
| 8 | 0 | 0 | 0 | 0 | 1 | 0 | 0 | 0 | 0 | 1 | 0 | 0 | 0 | 0 | 0 | 0 | 0 | 0 | 0 | 1 |

706'

FIG. 9

| k \ n | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 1 | 0 | 0 | 0 | 0 | 1 | 0 | 0 | 0 | 1 | 0 | 0 | 0 | 0 | 0 | 0 | 0 | 0 | 1 | 0 | 0 |
| 2 | 0 | 0 | 1 | 0 | 0 | 0 | 1 | 0 | 0 | 0 | 0 | 0 | 0 | 0 | 0 | 1 | 0 | 0 | 0 | 0 |
| 3 | 1 | 0 | 0 | 0 | 1 | 0 | 0 | 0 | 0 | 0 | 0 | 0 | 0 | 1 | 0 | 0 | 0 | 0 | 0 | 0 |
| 4 | 0 | 0 | 1 | 0 | 0 | 0 | 0 | 0 | 0 | 0 | 0 | 1 | 0 | 0 | 0 | 0 | 0 | 0 | 1 | 0 |
| 5 | 1 | 0 | 0 | 0 | 0 | 0 | 0 | 0 | 0 | 1 | 0 | 0 | 0 | 0 | 0 | 0 | 1 | 0 | 0 | 0 |
| 6 | 0 | 0 | 0 | 0 | 0 | 0 | 0 | 1 | 0 | 0 | 0 | 0 | 0 | 0 | 1 | 0 | 0 | 0 | 1 | 0 |
| 7 | 0 | 0 | 0 | 0 | 0 | 1 | 0 | 0 | 0 | 0 | 0 | 0 | 1 | 0 | 0 | 0 | 1 | 0 | 0 | 0 |
| 8 | 0 | 0 | 0 | 1 | 0 | 0 | 0 | 0 | 0 | 0 | 1 | 0 | 0 | 0 | 1 | 0 | 0 | 0 | 0 | 0 |

707'

FIG. 10

EFFICIENT CODEBOOK SEARCH FOR CELP VOCODERS

U.S. patent applications entitled "CELP Vocoder with Efficient Adaptive Codebook Search", Ser. No. 708,947, and "Reduced Codebook Search Arrangement for CELP Vocoders", Ser. No. 708,609, and "Efficient Calculation of Autocorrelation Coefficients for CELP Vocoder Adaptive Codebook", Ser. No. 714,409, by the same inventors and commonly assigned are related.

FIELD OF THE INVENTION

The present invention concerns an improved means and method for digital coding of speech or other analog signals and, more particularly, code excited linear predictive coding.

BACKGROUND OF THE INVENTION

Code Excited Linear Predictive (CELP) coding is a well-known stochastic coding technique for speech communication In CELP coding, the short-time spectral and long-time pitch are modeled by a set of time-varying linear filters. In a typical speech coder based communication system, speech is sampled by an A/D converter at approximately twice the highest frequency desired to be transmitted, e.g., an 8 KHz sampling frequency is typically used for a 4 KHz voice bandwidth. CELP coding synthesizes speech by utilizing encoded excitation information to excite a linear predictive (LPC) filter. The excitation, which is used as inputs to the filters, is modeled by a codebook of white Gaussian signals. The optimum excitation is found by searching through a codebook of candidate excitation vectors on a frame-by-frame basis.

LPC analysis is performed on the input speech frame to determine the LPC parameters. Then the analysis proceeds by comparing the output of the LPC filter with the digitized input speech, when the LPC filter is excited by various candidate vectors from the table, i.e., the code book. The best candidate vector is chosen based on how well speech synthesized using the candidate excitation vector matches the input speech. This is usually performed on several subframes of speech After the best match has been found, information specifying the best codebook entry, the LPC filter coefficients and the gain coefficients are transmitted to the synthesizer. The synthesizer has the same copy of the codebook and accesses the appropriate entry in that codebook, using it to excite the same LPC filter.

The codebook is made up of vectors whose components are consecutive excitation samples. Each vector contains the same number of excitation samples as there are speech samples in the subframe or frame. The excitation samples can come from a number of different sources, Long term pitch coding is determined by the proper selection of a code vector from an adaptive codebook. The adaptive codebook is a set of different pitch periods of the previously synthesized speech excitation waveform.

The optimum selection of a code vector, either from the stochastic or the adaptive codebooks, depends on minimizing the perceptually weighted error function. This error function is typically derived from a comparison between the synthesized speech and the target speech for each vector in the codebook. These exhaustive comparison procedures require a large amount of computation and are usually not practical for a single Digital Signal Processor (DSP) to implement in real time. The ability to reduce the computation complexity without sacrificing voice quality is important in the digital communications environment.

The error function, codebook vector search, calculations are performed using vector and matrix operations of the excitation information and the LPC filter. The Problem is that a large number of calculations, for example, approximately $5\times10^8$ multiply-add operations per second for a 4.8 Kbps vocoder, must be performed. Prior art arrangements have not been entirely successful in reducing the number of calculations that must be performed. Thus, a need continues to exist for improved CELP coding means and methods that reduce the computational burden without sacrificing voice quality.

A prior art 4.8 k bit/second CELP coding system is described in Federal Standard FED-STD-1016 issued by the General Services Administration of the United States Government. Prior art CELP vocoder systems are described for example in U.S. Pat. Nos. 4,899,385 and 4,910,781 to Ketchum et al., 4,220,819 to Atal, 4,797,925 to Lin, and 4,817,157 to Gerson, which are incorporated herein by reference.

Typical prior art CELP vocoder systems use an 8 kHz sampling rate and a 30 millisecond frame duration divided into four 7.5 millisecond subframes. Prior art CELP coding consists of three basic functions: (1) short delay "spectrum" prediction, (2) long delay "pitch" search, and (3) residual "code book" search.

While the present invention is described for the case of analog signals representing human speech, this is merely for convenience of explanation and, as used herein, the word "speech" is intended to include any form of analog signal of bandwidth within the sampling capability of the system.

SUMMARY OF THE INVENTION

A new way of CELP coding speech simplifies the recursive loop used to poll stochastic code book vectors by more quickly and easily determining the correlation coefficients of stochastic codebook vectors with other vectors generated by the CELP codingprocess in order to identify the optimum stochastic codebook vector for replicating the target speech.

There is provided in general a method for CELP coding speech by using a combination of a first vector V(n) having values identified by index n running from n=1 to N, and a set of the second vectors $S_k(n)$ wherein each of the second vectors is identified by index k and wherein each of the second vectors has up to N values which are either zero or non-zero and are identified by index n from n=1 to N, comprising, identifying indices $n_{k,i}$ of $S_k(n)$ for different k wherein $S_k(ni)$ are non-zero, adding values of the V(n) corresponding to indices $n_{k,i}$ to form sums Q(k), identifying the value k=j corresponding to the largest value Q(k=j), and synthesizing.-speech using $S_{k=j}(n)$.

In a preferred embodiment, successive vectors of the set of second vectors are determined by overlap of the preceding second vector according to an overlap amount $\Delta k,\Delta n$, and the identifying and adding steps comprise, identifying for k=1 indices $n_{1,i}$ of $S_k(n)$ wherein $S_1(n_i)$ are non-zero, starting from $n_{1,i}$ and using the overlap amount $\Delta k,\Delta n$, determining further indices $n_{k,i'}$ for k>1 wherein $S_k(n_{i'})$ are non-zero, and adding values of the V(n) for such indices and further indices to form sums Q(k). This procedure using the overlap amount.

In another embodiment an N by N multiplexer having n=1 to N outputs, n=1 to N first inputs, second inputs, and n=1 to N select means is used to combine the vectors, wherein a first logic level presented to nth select means couples the $n^{th}$ output to the $n^{th}$ first input and a second logic level presented to the $n^{th}$ select means couples the $n^{th}$ output to the second input, supplying n=1 to N values of the first vector to the n=1 to N first inputs of the multiplexer, presenting n=1 to N values of the second vector of index k=1 to n=1 to N select means of the multiplexer, the second vector providing at the n=1 to N select means the first logic level for some values of n and the second logic level for other values of n, adding together values of the first vector coupled to the multiplexer output to provide a sum, repeating the presenting, and adding steps for further values of k, and synthesizing speech based on whichever second vector has the sum giving the closest match to target speech. Desirably, the method further comprises determining which vector k=j has the largest sum.

In a still further embodiment, each second vector is divided into two portion, a first portion having values 0, +1 corresponding to the location of values of 0, +1 of the second vector and a second portion having values 0, +1 corresponding to the location of values 0, −1 of the second vector, and the steps of providing first and second N by N multiplexers each having n=1 to N outputs, n=1 to N first inputs, second inputs, and n=1 to N select means, wherein a first logic level presented to $n^{th}$ select means couples the $n^{th}$ output to the $n^{th}$ first input and a second logic level presented to the $n^{th}$ select means couples the $n^{th}$ output to the second input, supplying n=1 to N values of the first vector to the n=1 to N first inputs of the first and second multiplexers, presenting n=1 to N values of the k=1 first portion of the second vector to n=1 to N select means of the first multiplexer, adding together values of the first vector coupled to the output of the first multiplexer to provide a first sum, presenting the n=1 to N values of the k=1 second portion of the second vector to n=1 to N select means of the second multiplexer, adding together values of the first vector at the output of the second multiplexer to provide a second sum, combining the first and second sums to provide a result, repeating the presenting, adding and combining steps for further values of k, and synthesizing speech based on whichever second vector has the result giving the closest match to target speech.

There is provided an apparatus for CELP coding speech by combining a first vector and with a set of second vectors identified by an index k, wherein the first and second vectors having values identified by an indices n running from n=1 to N, comprising, an N by N multiplexer having n=1 to N outputs, n=1 to N first inputs, second inputs, and n=1 to N select means, wherein a first logic level presented to $n^{th}$ select means couples the $n^{th}$ output to the $n^{th}$ first input and a second logic level presented to the $n^{th}$ select means couples the $n^{th}$ output to the second input, means for supplying n=1 to N values of the first vector to the n=1 to N first inputs of the multiplexer, means for presenting n=1 to N values of the second vector of index k=1 to the n=1 to N select means of the multiplexer, the second vector providing at the n=1 to N select means the first logic level for some values of n and the second logic level for other values of n, means coupled to the multiplexer output for adding together values of the first vector to provide a sum, means for indexing k from k=1 to k=K, and means for synthesizing speech based on whichever sum identifies a second vector giving the closest match to target speech. It is preferred to further have a means for determining which vector k=j has the largest sum.

In a preferred embodiment there is provided, memory means for storing first portions of the second vectors having values 0, 1 corresponding to the locations of values of 0, +1 of the second vectors, memory means for storing second portions of the second vectors having values 0, +1 corresponding to the locations of values 0, −1 of the second vectors, first and second N by N multiplexers each having n=1 to N outputs, n=1 to N first inputs, second inputs, and n=1 to N select means, wherein a+1 presented to $n^{th}$ select means couples the $n^{th}$ output to the $n^{th}$ first input and a 0 presented to the $n^{th}$ select means couples the $n^{th}$ output to the second input, the first multiplexer coupled to the first memory means and the second multiplexer coupled to the second memory means, supplying n=1 to N values of the first vector to the n=1 to N first inputs of the first and second multiplexers, presenting n=1 to N values of the k=1 first portion of the second vector to n=1 to N select means of the first multiplexer, first adder coupled to the outputs of the first multiplexer for summing values of the first vector appearing at outputs of the first multiplexer to produce a first sum, second adder coupled to the outputs of the second multiplexer for summing values of the first vector appearing at outputs of the second multiplexer to produce a second sum, means for combining the first and second sums to produce a result, means for indexing k to load first and second portions of other second vectors into the memory means, multiplex, add and combine to produce other results, and means for synthesizing speech based on whichever result identifies a second vector giving the closest match to target speech. It is desirable to have means for comparing the results for each value of k to determine the value of k having the largest result.

BRIEF DESCRIPTION OF THE DRAWING

FIG. 6 illustrates the content of a small stochastic codebook of a type used for CELP coding;

FIGS. 9–10 illustrate the content of first and second memory means whose entries correspond to non-zero entries of the codebook of FIG. 6.

DETAILED DESCRIPTION

Figure 1:
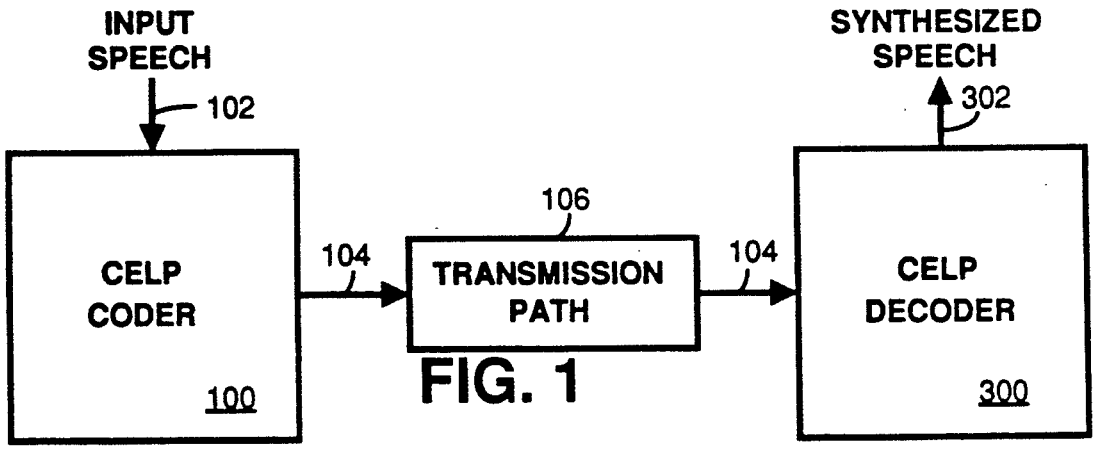
FIG. 1 PRIOR ART
FIG. 1 illustrates in simple block diagram and generalized form a CELP vocoder system.

FIG. 1 illustrates, in simplified block diagram form, a vocoder transmission system utilizing CELP coding.

CELP coder 100 receives incoming speech 102 and produces CELP coded output signal 104. CELP coded signal 104 is sent via transmission path or channel 106 to CELP decoder 300 where facsimile 302 of original speech signal 102 is reconstructed by synthesis. Transmission channel 106 may have any form, but typically is a wired or radio communication link of limited bandwidth. CELP coder 100 is frequently referred to as an "analyzer" because its function is to determine CELP code parameters 104 (e.g., code book vectors, gain information, LPC filter parameters, etc.) which best represent original speech 102. CELP decoder 300 is frequently referred to as a synthesizer because its function is to recreate output synthesized speech 302 based on incoming CELP coded signal 104. CELP decoder 300 is conventional and is not a part of the present invention and will not be discussed further.

Figure 2A:
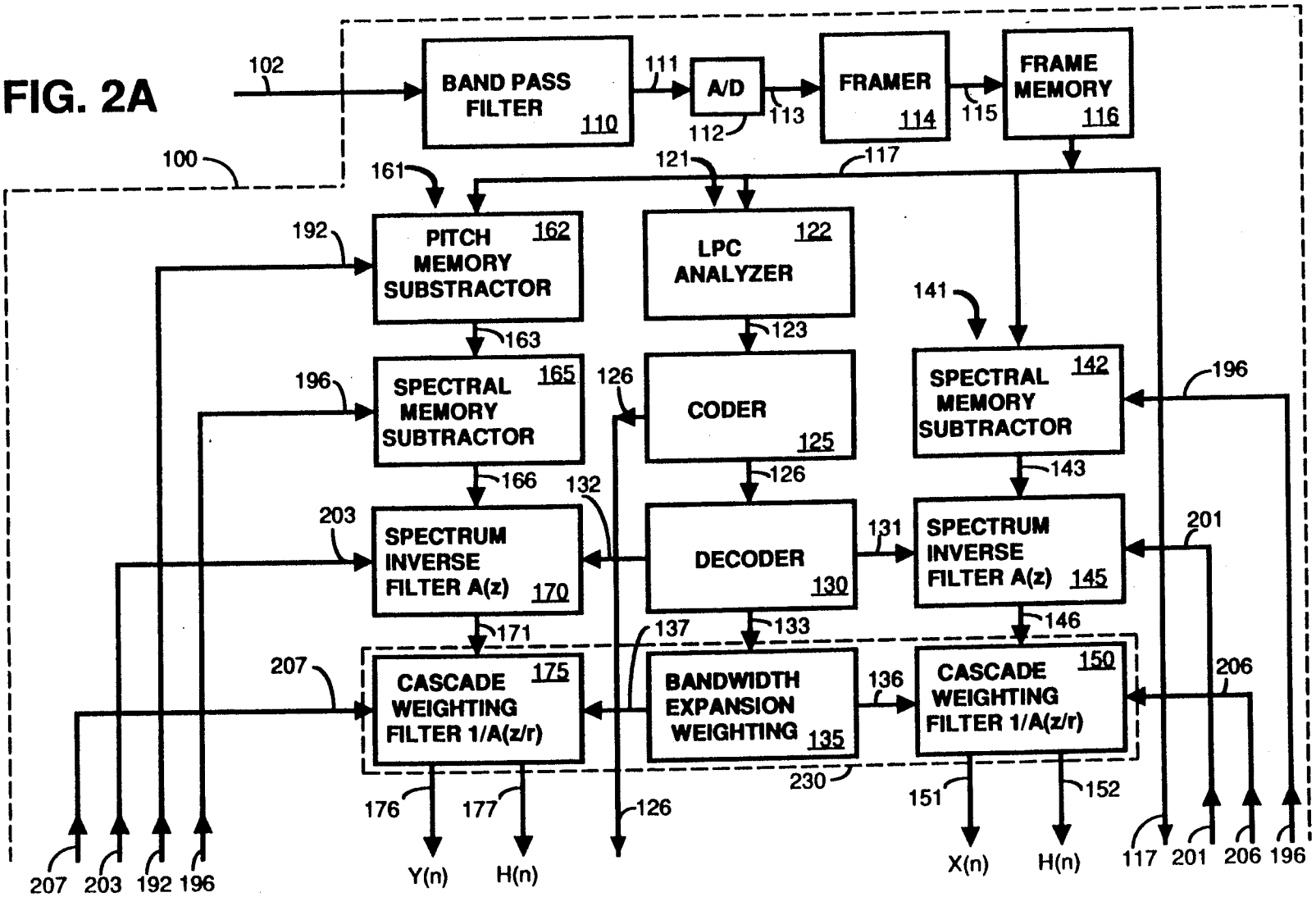
FIGS. 2A–B illustrates, in simplified block diagram form, a CELP coder according a preferred embodiment of the present invention.
Figure 2B:
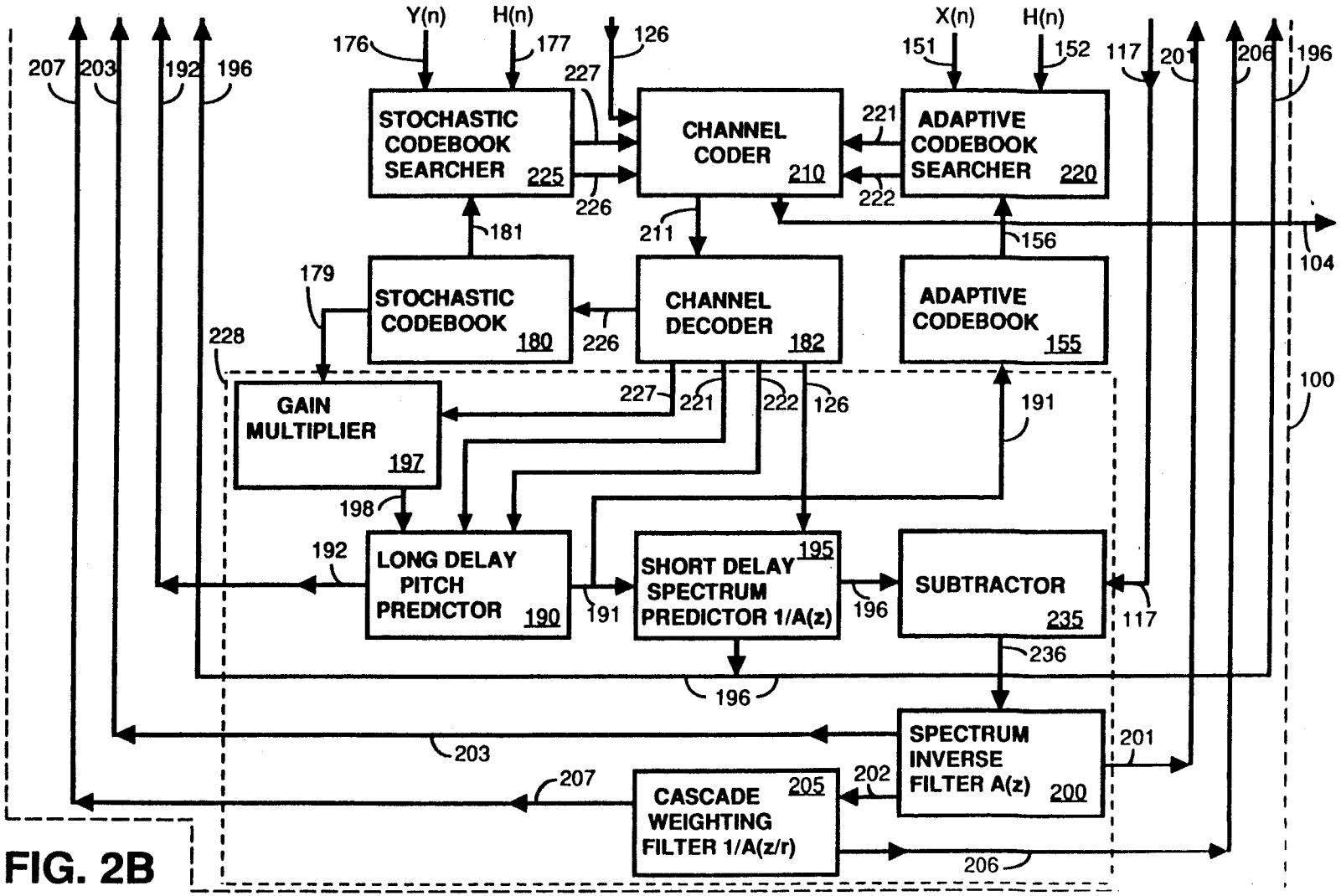

FIGS. 2A-B show CELP coder 100 in greater detail and according to a preferred embodiment of the present invention. Incoming analog speech signal 102 is first bandpassed by filter 110 to prevent aliasing. Bandpassed analog speech signal 111 is then sampled by analog to digital (A/D) converter 112. Sampling is usually at the Nyquist rate, for example at 8 KHz for a 4 KHz CELP vocoder. Other sampling rates may also be used. Any suitable A/D converter may be used. Digitized signal 113 from A/D converter 112 comprises a train of samples, e.g., a train of narrow pulses whose amplitudes correspond to the envelop of the speech waveform Digitized speech signal 113 is then divided into frames or blocks, that is, successive time brackets containing a predetermined number of digitized speech samples, as for example, 60, 180 or 240 samples per frame. This is customarily referred to as the "frame rate" in CELP processing. Other frame rates may also be used. This is accomplished in framer 114. Means for accomplishing this are well known in the art. Successive speech frames 115 are stored in frame memory 116. Output 117 of frame memory 116 sends frames 117 of digitized speech 115 to blocks 122, 142, 162 and 235 whose function will be presently explained.

Those of skill in the art understand that frames of digitized speech may be further divided into subframes and speech analysis and synthesis performed using subframes. As used herein, the word "frame", whether singular or plural, is intended to refer to both frames and subframes of digitized speech.

CELP coder 100 uses two code books, i.e., adaptive codebook 155 and stochastic codebook 180 (see FIG. 2B). For each speech frame 115, coder 100 calculates LPC coefficients 123 representing the formant characteristics of the vocal tract. Coder 100 also searches for entries (vectors) from both stochastic codebook 180 and adaptive codebook 155 and associated scaling (gain) factors that, when used to excite a filter with LPC coefficients 123, best approximates input speech frame 117. The LPC coefficients, the codebook vectors and the scaling (gain coefficient) information are processed and sent to channel coder 210 where they are combined to form coded CELP signal 104 which is transmitted by path 106 to CELP decoder 300. The process by which this is done will now be explained in more detail.

Referring now to data path 121 containing blocks 122, 125, 130 and 135, LPC analyzer 122 is responsive to incoming speech frames 117 to determine LPC coefficients 123 using well-known techniques. LPC coefficients 123 are in the form of Line Spectral Pairs (LSPs) or Line Spectral Frequencies (LSFs), terms which are well understood in the art. LSPs 123 are quantized by coder 125 and quantized LPC output signal 126 sent to channel coder 210 where it forms a part (i.e., the LPC filter coefficients) of CELP signal 104 being sent via transmission channel 106 to decoder 300.

Quantized LPC coefficients 126 are decoded by decoder 130 and the decoded LSPs sent via output signals 131, 132 respectively, to spectrum inverse filters 145 and 170, which are described in connection with data paths 141 and 161, and via output signal 133 to bandwidth expansion weighting generator 135. Signals 131, 132 and 133 contain information on decoded quantized LPC coefficients. Means for implementing coder 125 and decoder 130 are well known in the art.

Bandwidth expansion weighting generator 135 provides a scaling factor (typically $=0.8$) and performs the function of bandwidth expansion of the formants, producing output signals 136, 137 containing information on bandwidth expanded LPC filter coefficients. Signals 136, 137 are sent respectively, to cascade weighting filters 150 and 175 whose function will be explained presently.

Referring now to data path 141 containing blocks 142, 145 and 150, spectral predictor memory subtracter 142 subtracts previous states 196 (i.e., left by the immediately preceding frame) in short term spectrum predictor filter 195 (see FIG. 2B) from input sampled speech 115 arriving from frame memory 116 via 117. Subtractor 142 provides speech residual signal 143 which is digitized input speech 115 minus what is referred to in the art as the filter ringing signal or the filter ringdown. The filter ringing signal arises because an impulse used to excite a filter (e.g., LPC filter 195 in FIG. 2B) in connection with a given speech frame does not completely dissipate by the end of that frame, but may cause filter excitation (i.e., "ringing") extending into a subsequent frame. This ringing signal appears as distortion in the subsequent frame, since it is unrelated to the speech content of that frame. If the ringing signal is not removed, it affects the choice of code parameters and degrades the quality of the speech synthesized by decoder 300.

Speech residual signal 143 containing information on speech 115 minus filter ringing signal 196 is fed into spectrum inverse filter 145 along with signal 131 from decoder 130. Filter 145 is typically implemented as a zero filter (i.e. $A(z)=A_o+A_1z^{-1}+\ldots+A_nz^{-n}$ where the A's are LPC filter coefficients and z is "Z transform" of the filter), but other means well known in the art may also be used. Signals 131 and 143 are combined in filter 145 by convolution to create LPC inverse-filtered speech. Output signal 146 of filter 145 is sent to cascade weighting filter 150. Filter 150 is typically implemented as a pole filter (i.e., $1/A(z/r)$, where $A(z/r)=A_o+A_1rz^{-1}+\ldots+A_nr^nz^{-n}$, and the A's are LPC filter coefficients and r is an expansion factor and z is "Z transform" of the filter), but other means well known in the art may also be used.

Output signal 152 from block 150 is perceptually weighted LPC impulse function H(n) derived from the convolution of an impulse function (e.g., 1, 0, 0, ... , 0) with bandwidth expanded LPC coefficient signal 136 arriving from block 135. Signal 136 is also combined with signal 146 in block 150 by convolution to create at output 151, perceptually weighted short delay target speech signal X(n) derived from path 141.

Outputs 151 and 152 of weighting filter 150 are fed to adaptive codebook searcher 220. Target speech signal 151 (i.e., X(n)) and perceptually weighted impulse function signal 152 (i.e., H(n)) are used by the searcher 220 and adaptive codebook 155 to determine the pitch period (i.e., the excitation vector for filter 195) and the gain therefore which most closely corresponding to digitized input speech frame 117. The manner in which this is accomplished is explained in more detail in connection with FIGS. 3–4.

Referring now to data path 161 which contains blocks 162, 165, 170 and 175, pitch predictor memory subtractor 162 subtracts previous filter states 192 in long delay pitch Predictor filter 190 from digitized input sampled speech 115 received from memory 116 via 117 to give output signal 163 consisting of sampled speech minus the ringing of long delay pitch predictor filter 190. Output signal 163 is fed to spectrum predictor memory subtractor 165.

Spectral memory subtractor 165 performs the same function as described in connection with block 142 and subtracts out short delay spectrum predictor ("spectral") filter ringing or ringdown signal 196 from digitized input speech frame 117 transmitted via pitch subtracter 162. This produces remainder output signal 166 consisting of current frame sampled speech 117 minus the ringing of long delay ("pitch") filter 190 and short delay ("spectral") filter 195 left over from the previous frame. Remainder signal 166 is fed to spectrum inverse filter 170 which is analogous to block 145.

Inverse filter 170 receives remainder signal 166 and output 132 of decoder 130. Signal 132 contains information on decoded quantized LPC coefficients. Filter 170 combines signals 166 and 132 by convolution to create output signal 171 comprising LPC inverse-filtered speech. Output signal 171 is sent to cascade weighting filter 175 analogous to block 150.

Weighting filter 175 receives signal 171 from filter 170 and signal 137 from bandwidth expansion weighting generator 135. Signal 137 contains information on bandwidth expanded LPC coefficients. Cascade weighting filter 175 produces output signals 176, 177. Filter 175 is typically implemented as a pole filter (i.e. only poles in the complex plane), but other means well known in the art may also be used.

Signals 137, 171 are combined in filter 175 by convolution to create at output 177, perceptually weighted LPC impulse function H(n) derived from path 121, and create at output 176, perceptually weighted long delay and short delay target speech signal Y(n) derived from path 161. Output signals 176, 177 are sent to stochastic searcher 225.

Stochastic searcher 225 uses stochastic codebook 180 to select an optimum white noise vector and a optimum scaling (gain) factor which, when applied to pitch and LPC filters 190, 195 of predetermined coefficients, provide the best match to input digitized speech frame 117. Stochastic searcher 225 performs operations well known in the art and generally analogous to those performed by adaptive searcher 220 described more fully in connection with FIGS. 3–4.

In summary, in chain 141, spectrum inverse filter 145 receives LSPs 131 and residual 143 and sends its output 146 to cascade weighting filter 150 to generate perceptually weighted LPC impulse function response H(n) at output 152 and perceptually weighted short delay target speech signal X(n) at output 151. In chain 161, spectrum inverse filter 170 receives LSPs 132 and short delay and long delay speech residual 166, and sends its output 171 to weighting filter 175 to generate perceptually weighted LPC impulse function H(n) at output 177 and perceptually weighted short and long term delay target speech signal Y(n) at output 176.

Blocks 135, 150, 175 collectively labelled 230 provide the perceptual weighting function. The decoded LSPs from chain 121 are used to generate the bandwidth expand weighting factor at outputs 136, 137 in block 135. Weighting factors 136, 137 are used in cascade weighting filters 150 and 175 to generate perceptually weighted LPC impulse function H(n). The elements of perceptual weighting block 230 are responsive to the LPC coefficients to calculate spectral weighting information in the form of a matrix that emphasizes those portions of speech that are known to have important speech content. This spectral weighting information $1/A(z/r)$ is based on finite impulse response H(n) of cascade weighting filters 150, and 175. The utilization of finite impulse response function H(n) greatly reduces the number of calculations which codebook searchers 220 and 225 must perform. The spectral weighting information is utilized by the searchers in order to determine the best candidate for the excitation information from the codebooks 155 and 180.

Continuing to refer to FIGS. 2A–B, adaptive codebook searcher 220 generates optimum adaptive codebook vector index 221 and associated gain 222 to be sent to channel coder 210. Stochastic codebook searcher 225 generates optimum stochastic codebook vector index 226, and associated gain 227 to be sent to channel coder 210. These signals are encoded by channel coder 210.

Channel coder 210 receives five signals: quantized LSPs 126 from coder 125, optimum stochastic codebook vector index 226 and gain setting 227 therefore, and optimum adaptive codebook vector index 221 and gain setting 222 therefore. The output of channel coder 210 is serial bit stream 104 of the encoded parameters. Bit stream 104 is sent via channel 106 to CELP decoder 300 (see FIG. 1) where, after decoding, the recovered LSPs, codebook vectors and gain settings are applied to identical filters and codebooks to produce synthesized speech 302.

As has already been explained, CELP coder 100 determines the optimum CELP parameters to be transmitted to decoder 300 by a process of analysis, synthesis and comparison. The results of using trial CELP parameters must be compared to the input speech frame by frame so that the optimum CELP parameters can be selected. Blocks 190, 195, 197, 200, 205, and 235 are used in conjunction with the blocks already described in FIGS. 2A–B to accomplish this. The selected CELP parameters (LSP coefficients, codebooks vectors and gain, etc.) are passed via output 211 to decoder 182 from whence they are distributed to blocks 190, 195, 197, 200, 205, and 235 and thence back to blocks 142, 145, 150, 162, 165, 170 and 175 already discussed.

Block 182 is identified as a "channel decoder" having the function of decoding signal 211 from coder 210 to recover signals 126, 221, 222, 226, 227. However, those of skill in the art will understand that the code-decode operation indicated by blocks 210–182 may be omitted and signals 126, 221, 222, 226, 227 fed in uncoded form to block 182 with block 182 merely acting as a buffer for distributing the signals to blocks 190, 195, 197, 200, 205, and 235. Either arrangement is satisfactory, and the words "channel coder 182", "coder 182" or "block 182" are intended to indicate either arrangement or any other means for passing such information.

The output signals of decoder 182 are quantized LSP signal 126 which is sent to block 195, adaptive codebook index signal 221 which is sent to block 190, adaptive codebook vector gain index signal 222 which is sent to block 190, stochastic codebook index signal 226 which is sent to block 180, and stochastic codebook vector gain index signal 227 which is sent to block 197. These signals excite filter 190 thereby producing output 191 which is fed to to adaptive codebook 155 and to filter 195. Output 191 in combination with output 126 of coder 182, further excites filter 195 to produce synthesized speech 196.

Synthesizer 228 comprises gain multiplier 197, long delay pitch predictor 190, and short delay spectrum predictor 195, subtractor 235, spectrum inverse filter 200 and cascade weighting filter 205. Using the decoded parameters 126, 221, 222, 226 and 227, stochastic code vector 179 is selected and sent to gain multiplier 197 to be scaled by gain parameter 226. Output 198 of gain multiplier 197 is used by long delay pitch predictor 190 to generate speech residual 191. Filter state output information 192, also referred to in the art as the speech residual of predictor filter 190, is sent to pitch memory subtracter 162 for filter memory update. Short delay spectrum predictor 195, which is an LPC filter whose parameters are set by incoming LPC parameter signal 126, is excited by speech residual 191 to produce synthesized digital speech output 196. The same speech residual signal 191 is used to update adaptive codebook 155.

Synthesized speech 196 is subtracted from digitized input speech 117 by subtracter 235 to produce digital speech remainder output signal 236. Speech remainder 236 is fed to the spectrum inverse filter 200 to generate residual error signal 202. Output signal 202 is fed to the cascade weighting filter 205, and output filter state information 206, 207 is used to update cascade weighting filters 150 and 175 as previously described in connection with signal paths 141 and 161. Output signal 201, 203, which is the filter state information of spectrum inverse filter 200, is used to update the spectrum inverse filters 145 and 170 as previously described in connection with blocks 145, 170.

Figure 3:
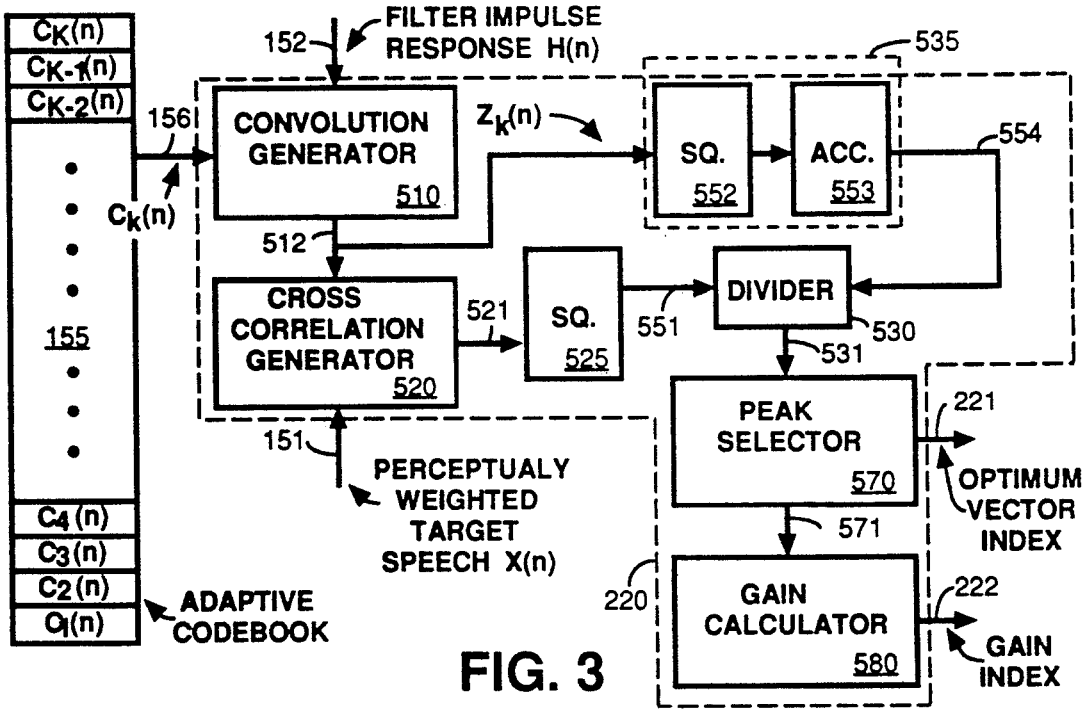
FIG. 3 illustrates, in greater detail, a portion of the coder of FIG. 2B, according to a first embodiment.
Figure 4:
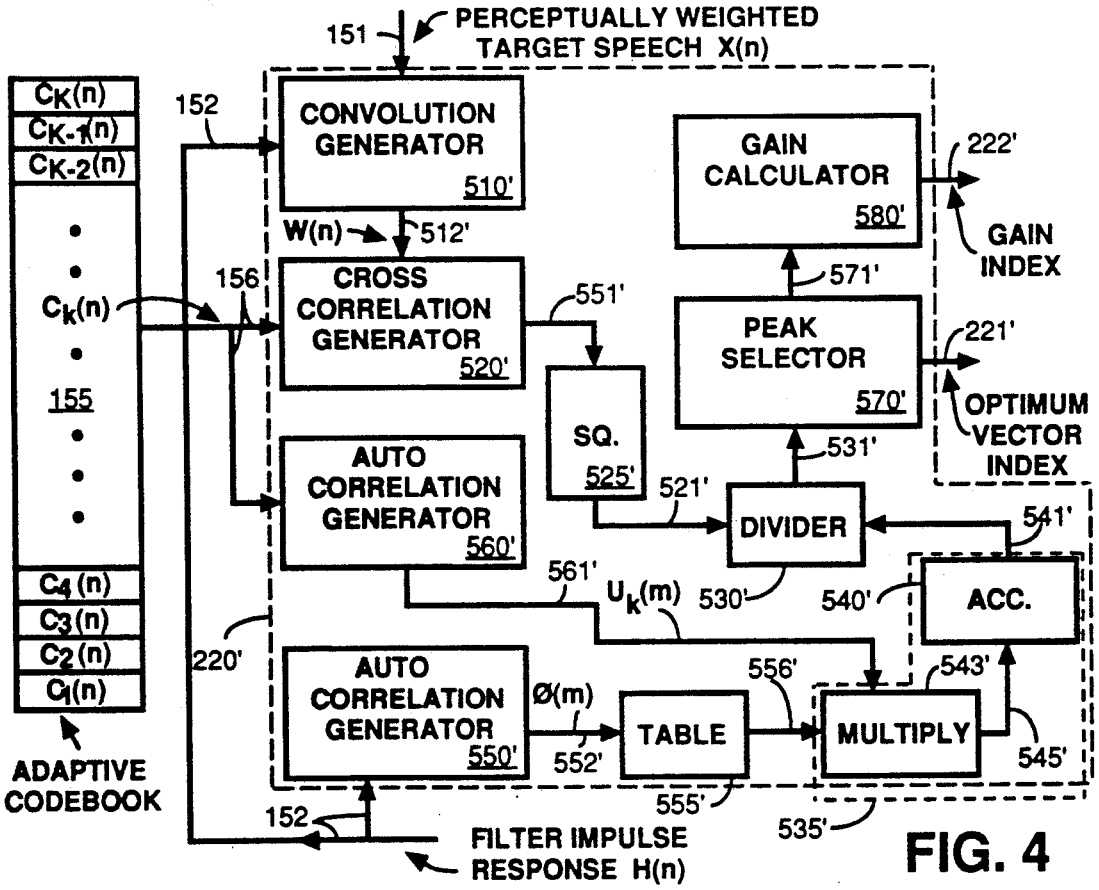
FIG. 4 illustrates, in greater detail, a portion of the coder of FIG. 2B, according to a preferred embodiment of the present invention.

FIGS. 3–4 are simplified block diagrams of adaptive codebook searcher 220. FIG. 3 shows a suitable arrangement for adaptive codebook searcher 220 and FIG. 4 shows a further improved arrangement. The arrangement of FIG. 4 is preferred.

Referring now to FIGS. 3–4 generally, the information in adaptive codebook 155 is excitation information from previous frames For each frame, the excitation information consists of the same number of samples as the sampled original speech. Codebook 155 is conveniently organized as a circular list so that a new set of samples is simply shifted into codebook 155 replacing the earliest samples presently in the codebook. The new excitation samples are provided by output 191 of long delay pitch predictor 190.

When utilizing excitation information out of codebook 155, searcher 220 deals in sets, i.e., subframes and does not treat the vectors as disjointed samples. Searcher 220 treats the samples in codebook 155 as a linear array. For example, for 60 sample frames, searcher 220 forms the first candidate set of information by utilizing samples 1 through sample 60 from codebook 155, and the second set of candidate information by using samples 2 through 61 and so on. This type of codebook searching is often referred to as an overlapping codebook search. The present invention is not concerned with the structure and function of codebook 155, but with how codebook 155 is searched to identify the optimum codebook vector.

Adaptive codebook searcher 220 accesses previously synthesized pitch information 156 already stored in adaptive codebook 155 from output 191 in FIG. 2B, and utilizes each such set of information 156 to minimize an error criterion between target excitation 151 received from block 150 and accessed excitation 156 from codebook 155. Scaling factor or gain index 222 is also calculated for each accessed set of information 156 since the information stored in adaptive codebook 155 does not allow for the changes in dynamic range of human speech or other input signal.

The preferred error criterion used is the Minimum Squared Prediction Error (MPSE), which is the square of the difference between the original speech frame 115 from frame memory output 117 and synthetic speech 196 produced at the output of block 195 of FIG. 2B. Synthetic speech 196 is calculated in terms of trial excitation information 156 obtained from the codebook 155. The error criterion is evaluated for each candidate vector or set of excitation information 156 obtained from codebook 155, and the particular set of excitation information 156' giving the lowest error value is the set of information utilized for the present frame (or subframe).

After searcher 220 has determined the best match set of excitation information 156' to be utilized along with a corresponding best match scaling factor or gain 222', vector index output signal 221 corresponding to best match index 156' and scaling factor 222 corresponding to the best match scaling factor 222' are transmitted to channel encoder 210.

FIG. 3 shows a block diagram of adaptive searcher 220 according to a first embodiment and FIG. 4 shows adaptive searcher 220' according to a further improved and preferred embodiment. Adaptive searchers 220, 220' perform a sequential search through the adaptive codebook 155 vectors indices $C_1(n) \ldots C_K(n)$. During the sequential search operation, searchers 220, 220' accesses each candidate excitation vector $C_k(n)$ from the codebook 155 where k is an index running from 1 to K identifying the particular vector in the codebook and where n is a further index running from $n=1$ to $n=N$ where N is the number of samples within a given frame. In a typical CELP application $K=256$ or 512 or 1024 and $N=60$ or 120 or 240, however, other values of K and N may also be used.

Adaptive codebook 155 contains sets of different pitch periods determined from the previously synthesized speech waveform. The first sample vector starts from the Nth sample of the synthesized speech waveform $C_k(N)$ which is located from the current last sample of the synthesized speech waveform back N samples In human voice, the pitch frequency is generally around 40 Hz to 500 Hz. This translates to about 200 to 16 samples. If fractional pitch is involved in the calculation, K can be 256 or 512 in order to represent the pitch range. Therefore, the adaptive codebook contains a set of K vectors $C_k(n)$ which are basically samples of one or more pitch periods of a particular frequency.

Referring now to FIG. 3, convolution generator 510 of adaptive codebook searcher 220 convolves each codebook vector $C_k(n)$, i.e., signal 156, with perceptually weighted LPC impulse response function H(n), i.e., signal 152 from cascade weighted filter 150. Output 512 of convolution generator 510 is then cross-correlated with target speech residual signal X(n) (i.e., signal 151 of FIGS. 2A–B) in cross-correlator 520. The convolution and correlation are done for each codebook vector $C_k(n)$ where $n=1, \ldots, N$. The operation performed by convolution generator 510 is expressed mathematically by equation (1) below:

$$Z_k(n) = \sum_{m=1}^{n} C_k(m)H(n-m+1),\ n = 1, \ldots, N \tag{1}$$

The operation performed by cross correlation generator 520 is expressed mathematically by equation (2) below:

$$\sum_{n=1}^{N} Z_k(n)X(n)\ n = 1, \ldots, N \tag{2}$$

Output 512 of convolution generator 510 is also fed to energy calculator 535 comprising squarer 552 and accumulator 553 (accumulator 553 provides the sum of the squares determined by squarer 552). Output 554 is delivered to divider 530 which calculates the ratio of signals 551 and 554. Output 521 of cross-correlator 520 is fed to squarer 525 whose output 551 is also fed to divider 530. Output 531 of divider 530 is fed to peak selector circuit 570 whose function is to determine which value $C_k(m)$ of $C_k(n)$ produces the best match, i.e., the greatest cross-correlation. This can be expressed mathematically by equations (3a) and (3b). Equation (3a) expresses the error E.

$$E = X^2(n) - G_k\left[\sum_{n=1}^{N} X(n)\left[\sum_{m=1}^{n} C_k(m)H(n-m+1)\right]\right] \tag{3a}$$

To minimize error E is to maximize the cross-correlation expressed by equation (3b) below, where $G_k$ is defined by equation (4):

$$G_k\left[\sum_{n=1}^{N} X(n)\left[\sum_{m=1}^{n} C_k(m)H(n-m+1)\right]\right] \tag{3b}$$

The identification (index) of the optimum vector index $C_k(m)$ is delivered to output 221. Output 571 of peak selector 570 carries the gain scaling information associated with best match pitch vector $C_k(m)$ to gain calculator 580 which provides gain index output 222. The operation performed by gain calculator 580 is expressed mathematically by equation (4) below.

$$G_k = \frac{\sum_{n=1}^{N} X(n)\left[\sum_{m=1}^{n} C_k(m)H(n-m+1)\right]}{\sum_{n=1}^{N}\left[\sum_{m=1}^{n} C_k(m)H(n-m+1)\right]^2} \tag{4}$$

Outputs 221 and 222 are sent to channel coder 210. Means for providing convolution generator 510, cross-correlation generator 520, squarers 525 and 552 (which perform like functions on different inputs), accumulator 553, divider 530, peak selector 570 and gain calculator 580 are individually well known in the art.

While the arrangement of FIG. 3 provides satisfactory results it requires more computations to perform the necessary convolutions and correlations on each codebook vector than are desired. This is because convolution 510 and correlation 520 must both be performed on every candidate vector in code book 155 for each speech frame 117. This limitation of the arrangement of FIG. 3 is overcome with the arrangement of FIG. 4.

Adaptive codebook searcher 220' of FIG. 4 uses a frame of perceptually weighted target speech X(n) (i.e., signal 151 of FIG. 2A–B) to convolve with the impulse perceptually weighted response function H(n) of a short term LPC filter (i.e., output 152 of block 150 of FIG. 2) in convolution generator 510' to generate convolution signal W(n). This is done only once per frame 117 of input speech. This immediately reduces the computational burden by a large factor approximately equal to the number of candidate vectors in the codebook. This is a very substantial computational saving. The operation performed by convolution generator 510' is expressed mathematically by equation (5) below:

$$W(n) = \sum_{m=1}^{n} X(m)H(n-m+1),\ n = 1, \ldots, N \tag{5}$$

Output 512' of convolution generator 510' is then correlated with each vector $C_k(n)$ in adaptive codebook 155 by cross-correlation generator 520'. The operation performed by cross correlation generator 520' is expressed mathematically by equation (6) below:

$$\sum_{n=1}^{N} W(n)C_k(n),\ n = 1, \ldots, N \tag{6}$$

Output 551' is squared by squarer 525' to produce output 521' which is the square of the correlation of each vector $C_k(n)$ normalized by the energy of the candidate vector $C_k(n)$. This is accomplished by providing each candidate vector $C_k(n)$ (output 156) to auto-correlation generator 560' and by providing filter impulse response H(n) (from output 152) to auto-correlation generator 550' whose outputs are subsequently manipulated and combined. Output 552' of auto-correlation generator 550' is fed to look-up table 555' whose function is explained later. Output 556' of table 555' is fed to multiplier 543' where it is combined with output 561' of auto-correlator 560'.

Output 545' of multiplier 543' is fed to accumulator 540' which sums the products for successive values of n and sends the sum 541' to divider 530' where it is combined with output 521' of cross-correlation generator 520'. The operation performed by auto-correlator 560' is described mathematically by equation (7) and the operation performed by auto-correlator 550' is described mathematically by equation (8)

$$U_k(m) = \sum_{n=1}^{N} [C_k(n)C_k(m+n)],\ m = 0, \ldots, N-1 \tag{7}$$

$$\phi(m) = \sum_{n=1}^{N} [H(n)H(m+n)],\ m = 0, \ldots, N-1 \tag{8}$$

where, $C_k(n)$ is the $k^{th}$ adaptive code book vector, each vector being identified by the index k running from 1 to K, H(n) is the perceptually weighted LPC impulse response, N is the number of digitized samples in the analysis frame, and m is a dummy integer index and n is the integer index indicating which of the N samples within the speech frame is being considered.

The search operation compares each candidate vector $C_k(n)$ with the target speech residual X(n) using MSPE search criteria. Each candidate vector $C_k(n)$ received from output of codebook 155 is sent to autocorrelation generator 560' which generates all autocorrelation coefficients of the candidate vector to produce autocorrelation output signal 561' which is fed to energy calculator 535' comprising blocks 543' and 540'.

Autocorrelation generator 550' generates all the autocorrelation coefficients of the H(n) function to produce autocorrelation output signal 552' which is fed to energy calculator 535' through table 555' and output 556'. Energy calculator 535' combines input signals 556' and 561' by summing all the product terms of all the autocorrelation coefficients of candidate vectors $C_k(n)$ and perceptually weighted impulse function H(n) generated by cascade weighting filter 150. Energy calculator 535' comprises multiplier 543' to multiply the auto-correlation coefficients of the $C_k(n)$ with the same delay term of the auto-correlation coefficients of H(n) (signals 561' and 552') and accumulator 540' which sums the output of multiplier 543' to produce output 541' containing information on the energy of the candidate vector which is sent to divider 530'. Divider 530' performs the energy normalization which is used to set the gain. The energy of the candidate vector $C_k(n)$is calculated very efficiently by summing all the product terms of all the autocorrelation coefficients of candidate vectors $C_k(n)$ and perceptually weighted impulse function H(n) of perceptually weighted short term filter 150. The above-described operation to determine the loop gain Gk is described mathematically by equation (9) below.

$$G_k = \frac{\sum_{n=1}^{N} C_k(n)\left[\sum_{m=1}^{n} X(m)H(n-m+1)\right]}{U_k(o)\phi(o) + 2\sum_{n=1}^{N}[U_k(n)\phi(n)]} \tag{9}$$

where $C_k(n)$, X(m), H(n) $\phi_k(n)$, $U_k(n)$ and N are as previously defined and Gk is the loop gain for the $k^{th}$ code vector.

Table 555' permits the computational burden to be further reduced. This is because auto-correlation coefficients 552' of the impulse function H(n) need be calculated only once per frame 117 of input speech. This can be done before the codebook search and the results stored in table 555'. The auto-coefficients 552' stored in table 555 before the codebook search are then used later to calculate the energy for each candidate vector from adaptive codebook 155. This provides a further significant savings in computation.

The results of the normalized correlation of each vector in codebook 155 are compared in the peak selector 570' and the vector $C_k(m)$ which has the maximum cross-correlation value is identified by peak selector 570' as the optimum pitch period vector. The maximum cross-correlation can be expressed mathematically by equation (10) below, $$G_k\left[\sum_{n=1}^{N} X(n)\left[\sum_{m=1}^{n} C_k(m)H(n-m+1)\right]\right] \tag{10}$$

where $G_k$ is defined in equation (9) and m is a dummy integer index.

The location of the pitch period. i.e , the index of code vector $C_k(m)$ is provided at output 221' for transmittal to channel coder 210.

The pitch gain is calculated using the selected pitch period candidate vector $C_k(m)$ by the gain calculator 580' to generate the gain index 222'.

The means and method described herein substantially reduces the computational complexity without loss of speech quality. Because the computational complexity has been reduced, a vocoder using this arrangement can be implemented much more conveniently with a single digital signal processor (DSP), The means and method of the present invention can also be applied to other areas such as speech recognition and voice identification, which use Minimum Squared Prediction Error (MPSE) search criteria.

While the present invention has been described in terms of a perceptually weighted target speech signal X(n), sometimes called the target speech residual, produced by the method and apparatus described herein, the method of the present invention is not limited to the particular means and method used herein to obtain the perceptually weighted target speech X(n), but may be used with target speech obtained by other means and methods and with or without perceptual weighting or removal of the filter ringing.

As used herein the word "residual" as applied to "speech" or "target speech" is intended to include situations when the filter ringing signal has been subtracted from the speech or target speech. As used herein, the words "speech residual" or "target speech" or "target speech residual" and the abbreviation "X(n)" therefore, are intended to include such variations. The same is also true of the impulse response function H(n), which can be finite or infinite impulse response function, and with or without perceptual weighting. As used herein the words "perceptually weighted impulse response function" or "filter impulse response" and the notation "H(n)" therefore, are intended to include such variations Similarly, the words "gain index" or "gain scaling factor" and the notation Gk therefore, are intended to include the many forms which such "gain" or "energy" normalization signals take in connection with CELP coding of speech.

Even with the advantages presented by the embodiment illustrated in FIG. 4, a significant computational burden still remains For example, evaluation of the autocorrelation coefficients in block 560' of FIG. 4 (see equation (7)), requires (K).(N!) multiplications in order to calculate the energy normalization (gain) coefficients for the K vectors in codebook 155. Since K is typically of the order of 512 or 1024 and N is typically of the order of 60 or 120 or 240, (K).(N!)=(K).(N).(N−1).(N−2) . . . (2) is usually a very large number. These calculations are in addition to those required by the operations of blocks 510', 520', 550' and others needed to recursively determine the particular adaptive codebook vector $C_{k=j}(n)$ and corresponding value of $G_{k=j}$, as well as the best fit stochastic codebook vector and corresponding gain factor, which give the best fit (least error) of the target speech X(n) to the input speech. This requires a substantially amount of computational power to perform the necessary calculations in a reasonable time.

It has been found that the number of autocorrelation operations required to be performed on a codebook having K vectors of N entries per vector can be substantially reduced without significant adverse impact on speech quality. This is accomplishes by the method comprising, autocorrelating the codebook vectors for a first P of N entries ($P<<N$) to determine first autocorrelation values therefore, evaluating the K codebook vectors by producing synthetic speech using the K codebook vectors and the first autocorrelation values and comparing the result to the input speech, determining which S of K codebook vectors ($S<<K$) provide synthetic speech having less error compared to the input speech than the K-S remaining vectors evaluated, autocorrelating the codebook vectors for those S of K vectors for R entries ($P<R\leqq N$) in each codebook vector to provide second autocorrelation values therefore, re-evaluating the S of K vectors using the second autocorrelation values to identify which of the S codebook vectors provides the least error compared to the input speech, and forming the CELP code for the frame of speech using the identity of the codebook vector providing the least error. For K and N of the sizes described herein, p and S in the ranges of $5\leqq P\leqq 10$ and $1\leqq S\leqq 7$ are suitable. It is desirable that $R=N$ or $N-1$.

The above operations may also be described in terms of the equations and figures provided herein. For example, instead of recursively evaluating equation (7) for $m=0$ to $N-1$ for each $n=1$ to N, and for each value of $k=1$ to $k=K$, the following procedure is used:

(1) Perform autocorrelation of codebook vectors $C_k(n)$ in block 550' according to equation (7), for $m=0$ to $m=P$ where $P<<N$;

(2) Using the P values of $U_k(P)$ found thereby, recursively evaluate all K vectors $C_k(n)$ and choose those S of K vectors $C_k(n)$, $S<<K$, providing the closest match to the input speech; then (3) Recursively ré-evaluate the S of K vectors chosen in step (2) above now using more than the initially chose P values, preferably all $m=0$ to $m=N-1$ values, for determining $U_k(m)$ in equation (7) to determine the $j^{th}$ value $C_{k=j}(n)$ and corresponding gain index or factor $Gk=j$ providing the best fit to the input speech; and (4) Send $C_{k=j}(n)$ and $G_{k=j}$ to channel coder 210, as before.

As used herein, "recursively" is intended to refer to the repetitive analysis-by-synthesis codebook search and error minimization procedure described in connection with FIGS. 2A-B and 4.

It has been found that output speech quality improves with increasing P up to about $P=10$ with little further improvement for $P>10$. Good speech quality is obtained for $5\leqq P\leqq 10$. Speech quality degrades rapidly for $P<5$. Since N is usually of the order of 60 or more, a significant computational saving is obtained.

It has been found that useful speech quality results for values of S as small as $S=1$, and that speech quality increases with increasing S. Beyond about $S=7$, further improvement in speech quality becomes difficult to detect. Thus, $1\leqq S\leqq 7$ is a useful operating range which provides significant reduction in the number of computations that must be performed during the recursive search for the optimum codebook vectors and corresponding gain index or factor. This makes it still easier to accomplish the desired VOCODER function using a dingle digital signal processor.

A further problem exists with respect to how the codebook entries are structured and the autocorrelation performed. This arises as a result of a procedure called "copy-up" that is frequently used in the prior art to facilitate identification of short pitch periods (e.g., see Ketchum et al., supra). This is explained below.

The energy term of the error function in an adaptive codebook search for the optimum pitch period can be reduced to a linear combination of autocorrelation coefficients of two function (see Eqs. 7-9). These two functions are the impulse response function H(n) of the perceptually weighted short-time linear filter and the codebook vectors $C_k(n)$ of the adaptive codebook The computational complexity is greater for the adaptive codebook than the stochastic codebook because the autocorrelation coefficients for the adaptive codebook vectors cannot be pre-computed and stored.

Each adaptive codebook vector is a linear array of N entries, also referred to as samples or values. Each entry is identified by an index n running from 1 to N or from N to 1. Adjacent vectors in the codebook differ from each other by one entry, that is, each successive vector has one new entry added at one end of the vector and one old entry dropped from the other end of the vector with the intervening entry remaining the same. Thus, except at the ends of the vector, adjacent vectors have identical entries displaced by one index number. If adjacent vectors are placed by side by side, they match up if displaced by one entry or sample. This is illustrated schematically below for hypothetical adjacent vectors k, k' having arbitrary entry values between 0 and 9 and indices $n=1-60$. This displacement is referred to as the codebook "overlap".

Example I - Vector Overlap Illustration

| | | |
|---|---|---|
| k(n): | 1,2,3,4,5,6,7, . . . , 55,56,57,58,59,60 | (index) |
| | 4,6,9,3,5,1,8, . . . , 0,4,6,8,2,3 | (values) |
| k'(n): | 1,2,3,4,5,6,7, . . . , 55,56,57,58,59,60 | (index) |
| | 6,9,3,5,1,8,5, . . . , 4,6,8,2,3,7 | (values) |

It can be seen that the vector k' has the same entries as adjacent vector k displaced by one index, and that an old entry has been dropped from one end (e.g., the value 4 is dropped the left end) of the vector and a new entry added at the other end (e.g., the value 7 added at the right end).

The autocorrelation function $U_k(m)$ is given by Eq. 7 where $m=0$ to $N-1$ is the "lag" value in the products $C_k(n)*C_k(n+m)$ and $n=1$ to N is the index of the vector entries. Up to now it has been assumed that the vector length N (i.e., the number of entries per codebook vector) and the frame length L (i.e., the number of speech samples per analysis frame) are the same. But this is not always so. Different strategies are used for determining autocorrelation coefficients depending on whether N and L are the same or different.

Where the vector length N is equal to or greater than a frame length L, the autocorrelation coefficients can be calculated by a process called add-delete end correction. For example, the zero order or zero delay (lag $m=0$) autocorrelation coefficients of successive adaptive codebook vectors $C_k$, $C_{k'}$, $C_{k''}$, etc., can be determined by calculating the sum of the $(C_k(n))^2$ for the first vector and finding the other vectors by end correction. End correction requires adding the square of the newly added vector value and subtracting off the square of the just deleted vector value. This same procedure can be followed (with some variations) for m=1, 2, 3, etc., with the result that the computational burden is reduced as compared to calculating each autocorrelation coefficient by evaluating Eq. 7 separately for each vector. This add-delete end correction process for determining autocorrelation coefficients is well known in the art.

Where the number of samples in the vector is less than a frame length L, it is common to "copy-up" the vector to fill out the frame (e.g., see Ketchum et al, supra). For example, if the frame length is 60 and only twenty entries are being used in the analysis, the 20 entries are repeated three times to obtain a vector length of sixty. This is illustrated below in terms of the indices of the vector values.

Example II - Copy-up

| | |
|---|---|
| Vector | 1,2, . . . , 59,60 |
| Copied-up vector | 1,2, . . . 19,20,1,2, . . . , 19,20,1,2, . . . , 19,20. |

This duplication or "copy-up" creates errors if one attempts to use the previously described add-delete end correction method for calculating the autocorrelation coefficients. These errors degrade the quality of the synthesized speech.

The end correction errors increase for larger values of m, i.e., the higher order (greater "lag") terms in the autocorrelation function The simple add-delete end correction procedure described earlier no longer works satisfactorily on copied-up vectors. One is then left with the undesirable choice of accepting poorer speech quality in order to have a smaller computational burden (e.g., easy end correction) or having higher speech quality and a large computational burden (e.g., calculate each vector separately). It has been found that the computational burden of obtaining the autocorrelation coefficients for the situation where the number of samples in the vector is less than a frame length can be reduced without loss of synthesized speech quality by an improved computational procedure and apparatus described below.

Assume that the analysis frame has a length L (e.g., 60) and codebook vectors with N samples or values (e.g., 60) are to be used in connection the with apparatus and procedure of FIGS. 2-4 to determine the adaptive codebook vector producing the best match to the target speech. Further assume that in order to quickly detect short pitch periods, a smaller subset M<N of vector values (e.g., M~20) are initially used for the analysis. In the past the M samples or values would have been copied-up to fill out the frame of length L and the analysis based on the copied-up frame. With the invented method, it is not necessary to copy-up the sub-frame of M values.

The description provided in connection with this embodiment is directed particularly to efficiently determining the autocorrelation coefficients of the adaptive codebook vectors and reference should be had to the discussion of FIGS. 2-4 for an explanation of the other portions of the analysis process used for choosing the codebook vector having the smallest error and the best match to the target speech.

Reference should also be had to Eq. 7 wherein the sum $U_k(n)$ over n=1 to N and m=0 to N−1 of the product $[C_k(n)*C_k(n+m)]$ is the autocorrelation coefficient of the $k^{th}$ vector. The index m runs ordinarily from 0 to N−1 and identifies the "lag" used to calculate the autocorrelation coefficient. The index k running from 1 to K identifies the codebook vector and the index n denotes an individual sample or value within the vector. The number of samples used in the analysis depends upon the pitch period being detected. For example, about 20 samples are required for the shortest pitch periods associated with the human voice and about 147 for the longest pitch periods.

The $0^{th}$ order autocorrelation coefficient corresponds to m=0, the $1^{st}$ order coefficient to m=1, and so forth. The "pitch lag" M<N is defined as the number of values in a vector that are to be used for the analysis. Thus, in determining the autocorrelation coefficients for short pitch period speech components, m varies from 0 to M. The "frame size" L is defined as the number of samples of speech in the 30 frame. Ordinarily, L=N. A typical value for L is 60 and a typical value for M is 20, but other values can be used for both provided that M<L. For convenience of explanation, the values of L=60 and M=20 are assumed in the discussion that follows. However, those of skill in the art will understand based on the description herein that this is not intended to be limiting and that other values of M and L can also be used.

The present invention provides a means and method for reducing the computational burden of determining the autocorrelation coefficients and avoiding the copy-up errors. It applies to the portion of the recursive analysis by synthesis procedure where copy-up was formerly used, that is, where a limited number of codebook samples (e.g., 20) are needed to quickly identify the shortest pitch periods, but where the limited number of samples must be expanded to the analysis frame length (e.g., 60) to avoid energy normalization problems Once the first M+k−1 vectors have been analyzed and vector expansion is completed so that N=L, then the autocorrelation coefficients are calculated by the add-delete end correction process discussed earlier.

In a preferred embodiment, the method of the present invention comprises:

(1) Determining the autocorrelation coefficient $U_k$ for the first vector k by evaluating Eq. 7 for m=0 to T<M and n=1 to M and multiply the result by L/M, where L, M, P, n, and m have the meanings described above. For L=60 and M=20, L/M=3. The parameter T determines how many values of the autocorrelation lag m are used, i.e., how many autocorrelation coefficients are calculated. Typically, T=M−1, but other smaller values of T may also be used. Using a smaller value of T is advantageous if the dominant values in the codebook vector are clustered so that the dominant autocorrelation coefficients are those for small values of m.

(2) Determining the autocorrelation coefficient $U_k$ for the second vector k' by taking the sum of the products in Eq. 7 for each value of m previously obtained in step (1) and adding $(C_{k'}(n=M+1))^2$ to the m=0 term, adding $C_{k'}(n=M+1)*C_{k'}(n=M+2)$ to the m=1 term, add $C_{k'}(n=M+1)*C_{k'}(n=M+3)$ to the m=2 term, and so forth up to the $T^{th}$ term, and multiply the result by L/(M+1);

(3) Determining the autocorrelation coefficient $U_k$ for the third vector k'' by taking the sum of the products for each value of m previously obtained in step (2) and adding $(C_{k''}(n=M+2))^2$ to the m=0 term, add $C_{k''}(n=M+2)*C_{k''}(n=M+3)$ to the m=1 term, add $C_{k''}(n=M+2)*C_{k''}(n=M+4)$ to the $m=2$ term, and so forth up to the $T^{th}$ term, and multiply the result by $L/(M+2)$; and (4) Determining the remaining autocorrelation coefficients for the remaining vectors by continuing as in (1)-(3) above, incrementing the values by one for each additional vector until $L/(M+k-1)=1$. Thereafter, the autocorrelation coefficients are calculated by the conventional prior art add-delete procedure described earlier.

Stated another way, the autocorrelation coefficients of the codebook vectors are determined by calculating the coefficient $U_k(m)$ of the first vector $k=1$ using Eqs. 11a-b below, $$U_1'(m) = \sum_{n=1}^{M} [C_1(n)C_1(n+m)] \tag{11a}$$

$$U_1(m) = \left(\frac{L}{M}\right) U_1'(m) \tag{11b}$$

for $m=0$ to $T<M$, and then calculating the autocorrelation coefficients $U_k(m)$ of the remaining codebook vectors incrementally using Eqs. 12a-b below.

$$U_k'(m) = [U_{k-1}'(m) + C_k(M+k-1)C_k(M+k-1+m)] \tag{12a}$$

$$U_k(m) = \left(\frac{L}{M+k-1}\right) U_k'(m) \tag{12b}$$

for $m=0$ to $T<M$ and for $(M+k-1) \leqq L$. The analysis by synthesis is performed using vectors (and their corresponding autocorrelation coefficients) of increasing length, starting with a vector of length M and increasing the length of each successive vector by one sample until the vector length equals the frame length, i.e., until $(M+k-1)=L$. The expansion of the short pitch sample to match the frame length is then complete. Subsequent vectors have the same length as the frame length and each successive vector of the overlapping codebook corresponds to deleting an old sample from one end and adding a new sample at the other end of the vector. The prior art add-delete end correction method is then used for determining the autocorrelation coefficients of the remaining vectors being analyzed.

It will be noted that the sum of the products in Eq. 11a need be evaluated only once for the first vector and then other vectors up to $(M+k-1)$ can be calculated from the terms of the first vector by adding the contribution of the $C_k*C_k$ products for the additional values or samples being included. No copy-up procedure is required and the errors in the autocorrelation coefficients created by copy-up do not arise. This substantially reduces the computational burden in the analysis by synthesis procedure described in connection with FIGS. 2-4.

The difference between the prior art copy-up and the invented procedure is illustrated schematically below in terms of the vector indices. Calculation of the autocorrelation coefficients involves summing the products of the vector with itself for various amounts of lag m, i.e., relative displacement of the vector. The examples below show which values are multiplied together for various amounts of lag m for the copy-up approach and the invented approach. The numbers in the examples are the indices of the vector values or entries, not the values themselves, and may be thought of as a measure of the position of each entry along the vector Example III - Copy-up Autocorrelation For COPY-UP, multiply term by term and add, for each n and m, for example:

```
For (k = 1, m = 0), multiply
    1,2,3, . . . , 19,20,1,2.3, . . . , 19,20,1,2,3, . . . , 19,20 by
    1,2,3, . . . , 19,20,1,2,3, . . . , 19,20,1,2,3, . . . , 19,20;
For (k = 2, m = 0), multiply
    1,2, . . . , 19,20,21,1,2, . . . , 19,20,21,1,2, . . . , 17,18 by
    1,2, . . . , 19,20,21,1,2, . . . , 19,20,21,1,2, . . . , 17,18;
For (k = 3, m = 0), multiply
    1,2, . . . , 19,20,21,22,1,2, . . . , 20,21,22,1,2, . . . , 15,16 by
    1,2, . . . , 19,20,21,22,1,2, . . . , 20,21,22,1,2, . . . , 15,16;
and so forth for all k, m and n . . .
```

Example IV - Improved Autocorrelation (m=0)

For the invented arrangement, multiply and sum the first (e.g. 20) entries for $m=0$ to $M-1$ and then add products of the $n=M+1$, $n=M+2$, etc., entries, for example:

```
For (k = 1, m = 0), calculate
    1,2,3, . . . , 19,20 times
    1,2,3, . . . , 19,20 and multiplying by L/M;
For (k = 2, m = 0)
    obtain  1,2,3, . . . , 19,20,21 times
            1,2,3, . . . , 19,20,21 by adding 21.21 to
            the previous calculation for k = 1, and
            multiplying by L/M + 1;
For (k = 3, m = 0)
    obtain  1,2,3, . . . , 19,20,21,22 times
            1,2,3, . . . , 19,20,21,22 by adding 22.22
            to the previous calculation for k = 2, and
            multiplying by L/M + 2; and
continuing for all m and until the vector length equals
the frame length and the last term 60.60 is added, then
proceed as in the prior art.
```

While only the $0^{th}$ order term is illustrated in the above examples of the autocorrelation process for the prior art and invented approach, those of skill in the art will understand based on the description herein how to shift the vectors to represent the product terms for $m=1$, $m=2$, etc. As an aid to that process, the following example is given for the present invention for $k=1$, $k=2$ and $m=1$:

Example V - Improved Autocorrelation (m=1)

```
For (k = 1, m = 1), calculate
    1,2,3, . . . , 19,20 times
    1,2, . . . , 18,19, and multiply by L/M + 1;
For (k = 2, m = 1)
    obtain  1,2,3, . . . , 19,20,21 times
            1,2,3, . . . , 19,20 by adding 20.21 to
            the previous calculation for k = 1 and
            multiplying by L/M + 2;
For (k = 3, m = 1)
    obtain  1,2,3, . . . , 19,20,21,22 times
            1,2,3, . . . , 19,20,21 by adding 21.22
            to the previous calculation for k = 2,and
            multiplying by L/M + 3; and
continuing for all k and m being evaluated up to
L/(M + k - 1) = 1.
```

Figure 5:
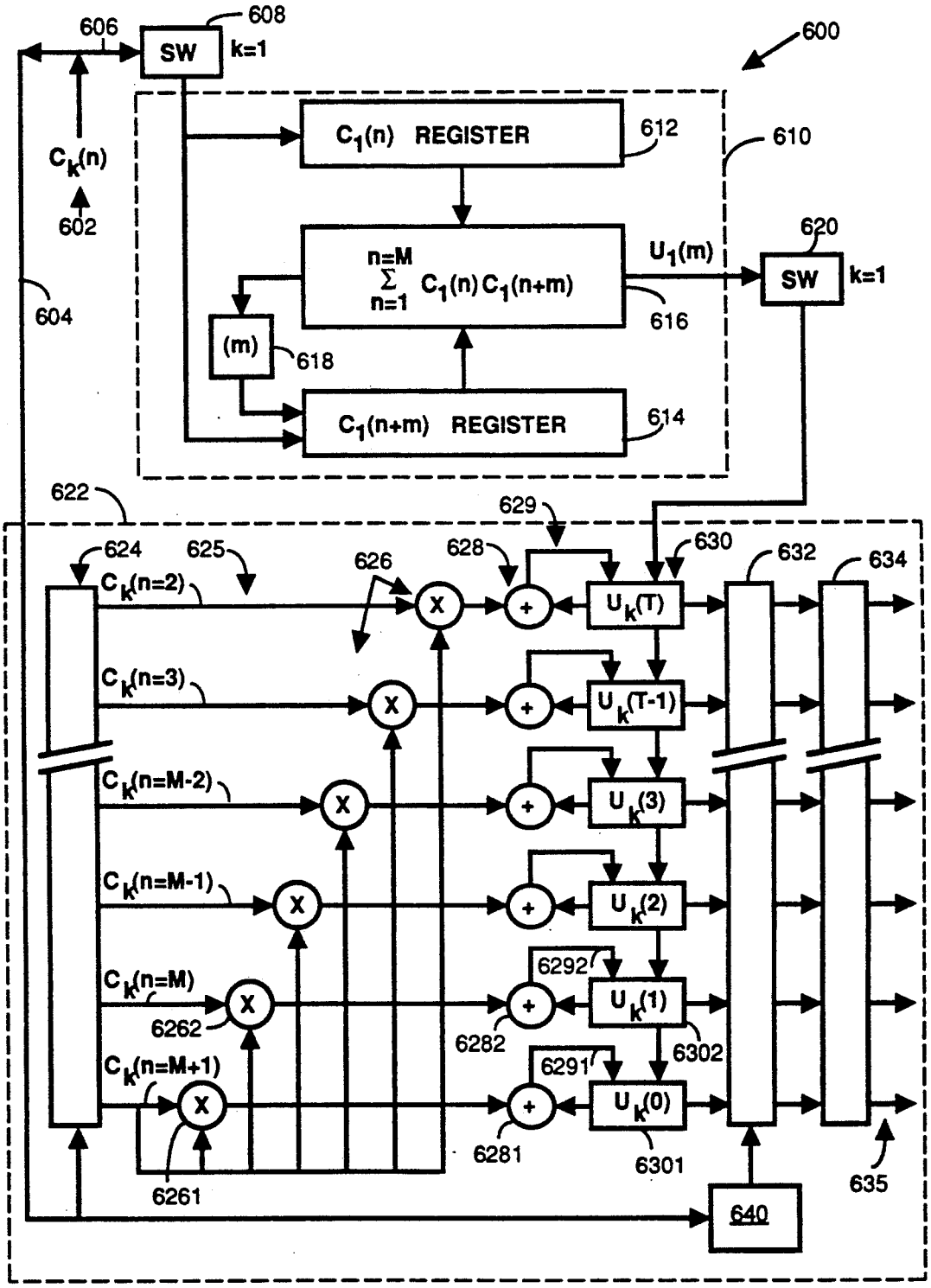
FIG. 5 illustrates an apparatus for providing autocorrelation coefficients of the adaptive codebook vectors according to a preferred embodiment of the present invention.

An apparatus suitable for determining the autocorrelation coefficients in the manner described above according to a preferred embodiment of the present invention is illustrated in FIG. 5. Autocorrelation apparatus 600 corresponding to the present invention comprises signal input 602 where vector samples $C_k(n)$ are received from adaptive codebook 155 of FIG. 4. Vector samples or values $C_k(n)$ follow two paths 604, 606. Path 606 passes via switch 608 to initial vector (i.e., $k=1$) autocorrelator 610. Initial vector autocorrelator 610 performs the functions indicated by Eq. 11a, that is, it calculates the autocorrelation coefficients $U_1(m)$ corresponding to $k=1$, $m=1, 2, 3, \ldots, T-1, T$. These autocorrelation coefficients are delivered via switch 620 to end correction coefficient calculator 622.

First vector autocorrelation coefficient calculator 610 comprises registers 612 and 614 into which the first M (e.g., 20) samples in the codebook are loaded. Registers 612, 614 are conveniently well known serial-in/parallel-out registers, but other arrangements well known in the art can also be used.

The sample values are transferred to autocorrelator 616 which determines the sum of the products $U_1(m)=SUM[C_1(n)C_1(n+m)]$ for $m=0$ (i.e., $U_1(0)$) and clocks this coefficient out to block 622 through switch 620. Autocorrelator 616 then shifts the samples in register 614 by one sample, via block 618, corresponding to $m=1$ and calculates $U_1(1)$, which is then clocked out to block 622. This procedure continues until all of the autocorrelation coefficients for initial vector $C_1(n)$ have been determined and loaded into block 622. Switches 608 and 620 then disconnects autocorrelation generator 610 from block 622.

Block 622 performs the function described by Eqs. 11b and 12a-b. This is conveniently accomplished by the combination of register 624, multipliers 626, adders 628, register-accumulators 630, multiplier 632 and output buffer 634. Registers 624, 630 and buffer 634 conveniently have the same length as registers 612, 614 (as shown for example in FIG. 5), but may be longer or shorter depending on how many autocorrelation coefficients are desired to be evaluated and updated for subsequent vectors. For example, registers 624, 630 and buffer 634 can be as large as the frame length.

Register elements 630 contain the previously calculated autocorrelation coefficients to which end corrections are to be added to determine the autocorrelation coefficients for subsequent vectors. The end corrections are provided by register 624 in combination with multipliers 626. The end corrections from multipliers 626 are added to the previously calculated coefficients from register 630 in adders 628 and fed back to update register 630 via loops 629. From register 630, the autocorrelation coefficients are transferred to multiplier 632 where they are scaled by the appropriate $L/(M+k-1)$ factor and sent to output buffer 634 where they form, for example, output 561' in FIG. 4, wherein autocorrelation generator 600 describes element 560' in more detail for $(M+k-1) \leqq L$..

Describing the operation of block 622 in more detail, register 624 is loaded with the vector values at the same time as registers 612, 614. Register 630 is loaded with output $U_1(m)$ of first vector autocorrelation coefficient generator 610 before autocorrelator 610 is disconnected from block 622. These initial autocorrelation coefficients are copied to multiplier 632 wherein they are multiplied by L/M and sent to buffer 634 from which they are extracted during the analysis by synthesis procedure described in connection with FIGS. 2-4.

After register 630 has been loaded with the first T autocorrelation coefficient values, then an additional vector value is clocked into register 624 and the vector value in each stage of register 624 is clocked out as shown by arrows 625. Assuming that the initial vector had M values, the most recent value now present in register 624 is $n=M+1$. This corresponds to vector $k=2$ since each vector differs from the previous vector by the addition of one entry until $n=(M+k-1)=L$.

The new value $n=M+1$ is multiplied by itself in multiplier 6261 and the result delivered to adder 6281 where it is combined with the $0^{th}$ order $U_1(m=0)$ coefficient already stored in register element 6301. Register element 301 is then updated as indicated by arrow 6291 so that the sum of $U_1(0)+C_k(M+1)C_k(M+1)$ is now present in register element 6301 and transferred to multiplier 632 where it is multiplied by $L/(M+1)$ and loaded into buffer 634, along with the other updated coefficient values from the other elements of register 630 which have been multiplied in 632 by the same factor. Counter 640 is provided to keep track of the number of codebook vector entries that have been loaded into register 624 and adjust the multiplication factor in multiplier 632 so that it corresponds to $L/(M)$ for $k=1$, $L/(M+1)$ for $k=2$, $L/(M+2)$, and so forth up to $(M+k-1)=L$.

Sample $C_k(M)$ from register 624 is multiplied by $C_k(M+1)$ in multiplier 6262 and summed with $U_1(I)$ from register element 6302 in adder 6282, which sum updates register element 6302 via connection 6292. The updated value is sent to multiplier 632 where it is multiplied by $L/(M+1)$ and sent to buffer 634. The remaining samples in register 624 are processed in a like manner and then another sample, e.g., $n=M+2$, clocked into register 624 and the process repeated. In this fashion, the autocorrelation coefficients are available in buffer 634 for each new vector formed by the addition of one more sample to the previous vector, in the same fashion as is illustrated in simplified form in Examples IV-V.

While the temporary storage elements 612, 614, 624, 630, and 634 have been described as registers or buffers, those of skill in the art will understand based on the description herein that this is merely for convenience of explanation and that other forms of data storage can also be used, as for example and not limited to, random accessible memory, content addressable memory, and so forth. In addition, such memory can have a wide varied of physical implementations, for example, flip-flops, registers, core and semiconductor memory elements As used herein the terms "register" and "buffer", whether singular or plural, are intended to include any modifiable information store of whatever kind or construction. Similarly, the other blocks identified, as for example, autocorrelator 616, indexer, 618, switches 608, 620, adders 628, multipliers 626 and/or counter 640, are intended to include equivalent functions of any form, whether separate elements or a combination of elements, or standard or application specific integrated circuits, or programmed general purpose processors able to perform the described functions, separately or in combination.

The present invention provides a rapid and simple method of determining the autocorrelation coefficients for a standard analysis frame length (e.g., 60) based on a shorter set of codebook vector samples (e.g., 20) which are needed to detect short pitch periods, without introducing the former copy-up errors involved in expanding the small number of codebook samples to the standard frame length. The computational burden is reduced without sacrifice of speech quality because the end autocorrelation add-delete errors associated with the prior art copy-up arrangement are avoided. Copy-up is avoided entirely.

While the invented apparatus for generating the autocorrelation coefficients has been described above in terms of hardware registers, autocorrelators, multipliers, adders, switches and the like, those of skill in the art will understand that these can be implemented in software so as to configure a computer to perform the same functions as have been described herein for the apparatus and to execute the method of the present invention based on the detailed description of the embodiments provided herein, and that such variations are contemplated by the present invention.

The above-described improvements significantly reduce the computational burden associated with determining the optimum codebook vectors for replicating target speech, but further improvement is still desired. In particular, improvement is desired in the manner in which the optimum vector of the stochastic codebook is identified.

In U.S. Pat. No. 4,797,925, L in describes a procedure for reducing the computational burden of considering all the vectors in the stochastic codebook by use of overlapping stochasitc vectors. With Lin's arrangement, each successive vector in the codebook differs from the preceding vector by having an old value dropped from one end of the vector and a new value added at the other end of the vector. With this arrangement, the number of unique values in a codebook composed of 1024 vectors each having 60 values is reduced from $1024 \times 60 = 61{,}440$ to $60 + 1023 = 1{,}083$. Even so, a large number of computations is still required to carry out the analysis and the steps are time consuming because they involve successive multiplication and addition.

Stochastic codebook 180 (see FIG. 2B) contains K vectors $S_k(n)$ of length N, where $k=1$ to K and $n=1$ to N, and K is conveniently 512, 1024, 2048, etc., typically 1024, and N is conveniently 20, 40, 60, 120, etc., typically 60. The indices k and n for stochastic codebook vectors $S_k(n)$ have the same interpretation as for adaptive codebook vectors $C_k(n)$, that is, k identifies which vector is being considered and n identifies the value being considered within vector k. It is convenient that index limits K and N for the vectors of stochastic codebook 180 have the same magnitudes as index limits K and N for the vectors of adaptive codebook 155, but this is not essential. Merely for convenience of explanation and not intending to be limiting, K and N are taken to have the same values for both codebooks, for example, $K=1024$ and $N=60$.

The vectors in stochastic codebook 180 are conveniently a linear array of pseudo-random 0's and 1's or 0's, 1's and −1's. That is, each vector $S_k(n)$ is a string of N values, each value identified by index n. FIG. 6 shows an exemplary ternary (e.g., 0, 1, −1) stochastic codebook 180' analogous to codebook 180 but with $K \doteq 8$ and $N=20$. Persons of skill in the art will understand based on the description herein how the features of the codebook of FIG. 6 apply for larger values of K and N. Further, while FIG. 6 illustrates a ternary (e.g., 0, 1, −1) codebook, a binary (e.g., 0, 1 or 0, −1) or other type of codebook may also be used. A ternary codebook is preferred.

The vectors $S_k(n)$ in FIG. 6 for each successive value of k overlap by $N-2$. For example, vector $S_{k=2}(n)$ differs from vector $S_{k=1}(n)$ by having two old values dropped from the left end of vector $S_1(n)$ and two new values added at the right end of vector $S_1(n)$. Thus, the values of vector $S_2(n)$ are shifted two places to the left compared to vector $S_1(n)$ and there are two new values at the right end. Each succeeding vector differs from the previous vector in the same way. The choice of overlap amount, e.g., $N-2$ in FIG. 6, is convenient but not essential. Any value of overlap may be employed, e.g., 1 to $N-1$. Also, while the vectors have been described as being shifted to the left with new values being added at the right, the opposite convention may also be used, i.e., shift right and add new values at the left.

The analysis procedure for identifying the optimal stochastic codebook vector is substantially the same as for the adaptive codebook vector, but with $S_k(n)$ substituted for $C_k(n)$, i.e., codebook 180 for codebook 155, and with the perceptually weighted short and long delay target speech signal Y(n) (see 176 of FIGS. 2A–B) substituted for the perceptually weighted short delay target speech signal X(n) (see 151 of FIGS. 2A–B). Eqs 1', 2', 5' and 6' below are analogous, respectively, to Eqs. 1, 2, 5, 6 presented earlier, but with the appropriate variables for the stochastic codebook substituted for those previously described for the adaptive codebook:

$$Z_k'(n) = \sum_{m=1}^{n} S_k(m)H(n-m+1),\ n = 1, \ldots, N \tag{1'}$$

$$\sum_{n=1}^{N} Z_k'(n)Y(n)\ n = 1, \ldots, N \tag{2'}$$

$$W'(n) = \sum_{m=1}^{n} Y(m)H(n-m+1),\ n = 1, \ldots, N \tag{5'}$$

$$\sum_{n=1}^{N} W'(n)S_k(n)\ n = 1, \ldots, N \tag{6'}$$

A significant difference between the stochastic and adaptive codebooks is that the vectors making up stochastic codebook 180 do not change as a result of the analysis-by-synthesis process, as do those in codebook 155, but are fixed. Thus, many of the computations represented by Eqs. 1'–6' can be performed once per frame and the result stored and reused. For example, the autocorrelation of the stochastic codebook vectors need be performed only once since the result is invariant. The autocorrelation coefficients are conveniently stored in a look-up table and need not be recomputed. This greatly simplifies the computational burden.

It has been discovered that the process involved in determining which of the stochastic codebook vectors best represents the target speech can be substantially simplified and made more rapid by eliminating the multiplication of the values of stochastic codebook vectors $S_k(n)$ by other signals nominally required by Eqs. 1', 2', 5', 6'. While the invented means and method is most usefully applied to the cross-correlation operations involving stochastic codebook vectors, it may also be applied to the convolution operations which involve stochastic codebook vectors. For convenience of explanation, the invented arrangement is described for the correlation operations, but those of skill in the art will understand based on the description herein how it may be applied to convolution operations.

Cross-correlation is accomplished in a first embodiment by means of a mutiplexer-accumulator combination where the select lines of the multiplexer are driven by the codebook or one or more replicas of the codebook. This is explained in more detail in connection with FIGS. 7-10.

Figure 7:
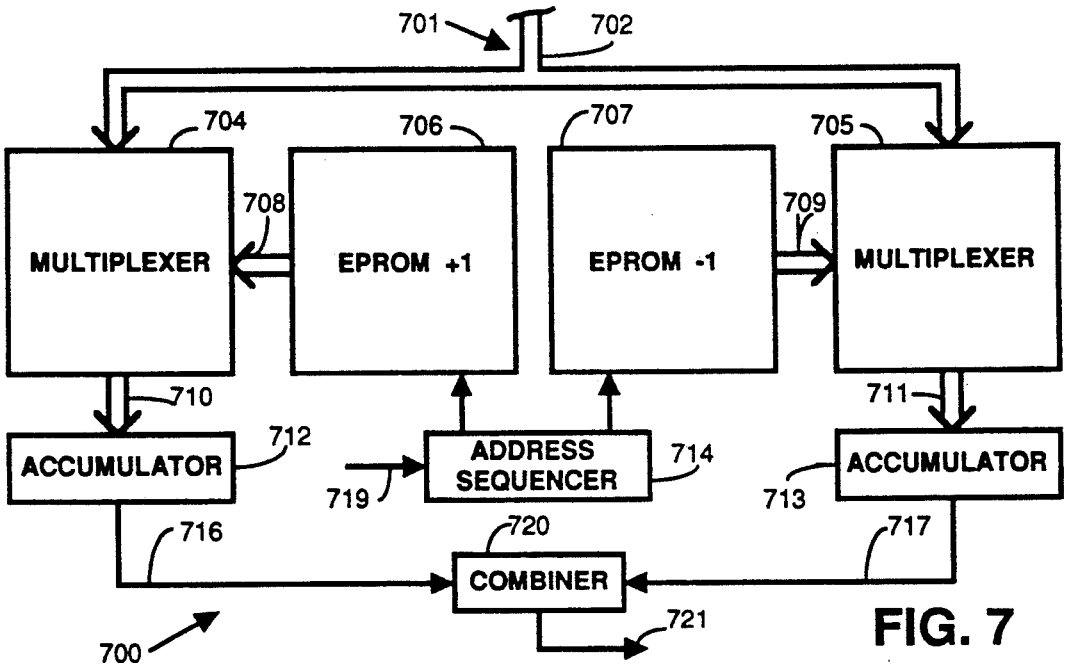
FIG. 7 is a simplified block diagram of a cross-section function according to the present invention.

FIG. 7 is a simplified block diagram of stochastic codebook cross-correlator 700 according to the present invention. Correlator 700 is shown for the case of a ternary (e.g., 0, 1, −1) codebook. Those of skill in the art will understand based on the description herein that the present invention applies to binary and other types of codebooks as well. The procedure described below can also be used to convolve the codebook vectors with other signals.

Correlator 700 has input 701 where it receives signal or signals 702 to be cross-correlated with the codebook vectors, as for example but not limited to, signal W'(n) from Eq. 5', or another signal to be correlated with the codebook vectors $S_k(n)$. Signals 702 received at input 701 are generally vectors having N values identified by an index, e.g., n or m running from 1 to N. For example, if Eq. 6' is being evaluated, then W'(n) is presented at input 701. If Eq. 1' is being evaluated, then H(n-m+1) is presented input at 701. While the invented arrangement is particularly useful in connection with speech VOCODERS, it may be used in connection with any signal or string of similar form.

For convenience of explanation, the means and method of the present invention are described for evaluation of Eq. 6', but those of skill in the art will understand based on the description herein that it applies to any other sum of the products of two vectors or vector arrays where one vector or vector array has fixed values, as for example but not limited to 1,0 or −1,0 or −1,0,1, while the other may be variable. The evaluation of Eq. 6' produces a single cross-correlation value Q(k) for each value of index k, that is:

$$Q(k) = \sum_{n=1}^{N} W'(n)S_k(n) \quad n = 1, \ldots, N \tag{6''}$$

Vector signal 702 (e.g., W'(n)) supplied to input 701 is transferred to multiplexers 704, 705. Multiplexers 704 is illustrated in more detail in FIG. 8 and multiplexer 705 is substantially identical. Coupled to multiplexer 704 is memory 706, as for example, a ROM or EPROM having non-zero entries corresponding to the 1's in codebook 180. Other type of memory may also be used, but non-volitile memory is most convenient. FIG. 9 illustrates the content of memory 706' analogous to memory 706 but with K=9 and N=20, and corresponding to the content of codebook 180' of FIG. 6. The indices k and n have the same function in connection with memory 706 (and memory 707) as in codebook 180, i.e., k identifying vectors or other data strings corresponding to vectors and n identifying values within the vectors or strings. Memory 706, 706' has 0's everywhere except where a 1 appears in codebook 180, 180' (compare FIGS. 6 and 9). The output of memory 706 is coupled to select lines 708 of multiplexer 704 so that each value k, n controls a particular select line n acting on the value of the vector being provided at input 701.

Coupled to multiplexer 705 is memory 707 which is analogous to memory 706 but having non-zero entries corresponding to the −1's in codebook 180. FIG. 10 illustrates the content of memory 707' analogous to memory 180' of FIG. 6. Memory 707, 707' has 1's everywhere a −1 appeared in codebook 180, 180' and 0's otherwise (compare FIGS. 6 and 10). The output of memory 707 is coupled to select lines 709 of multiplexer 705 so that each value k, n controls a particular select line n acting on the value of the vector being presented at input 701.

Memories 706, 707 are controlled by address sequencer 714. As the signal vector 702 is presented at input 701 to be correlated with the first (i.e., k=1) codebook vector, sequencer 714 accesses the k=1 data set of memories 706, 707 and transfers values n=1 to n=N for k=1 to corresponding multiplexers 704, 705 on select lines 708, 709. The values appearing on select lines 708, 709 cause multiplexers 704, 705 to pass the appropriate values of input vector 702 to accumulators 712, 713 where they are summed to produce outputs 716, 717. Outputs 716, 171 are combined in combiner 720 to provide the first cross-correlation, i.e., Q(1), at output 721.

Sequencer 714 then selects the k=2 values in memories 706, 707 and transfers the n=1 to N values therein for k=2 to select lines 708, 709 of multiplexers 704, 705, and so forth to produce the second cross-correlation, i.e., Q(2), output 721. This process is repeated until input vector signal 702 for a speech frame has been correlated with the codebook vectors represented by the entries in memories 706, 707 to obtain cross-correlation values Q(1), . . . , Q(K). The stochastic vector of index k=j having a larger value of Q(k=j) generally gives a better representation of speech than another vector k=i having a smaller value of Q(k=i).

While the use of two memories 706, 707 is convenient for a ternary codebook, more or fewer may be used according to the type of coding used in codebook 180. For example, only one memory need be used for a binary codebook, and the codebook itself can suffice as the memory if it is able to deliver the 0, 1 values corresponding to n=1 to N to the multiplexer select lines for each index k. Thus, in the case of a binary codebook or equivalent, a separate memory may not be required and the codebook itself can be used to supply signals to the select lines of the multiplexer.

Figure 8:
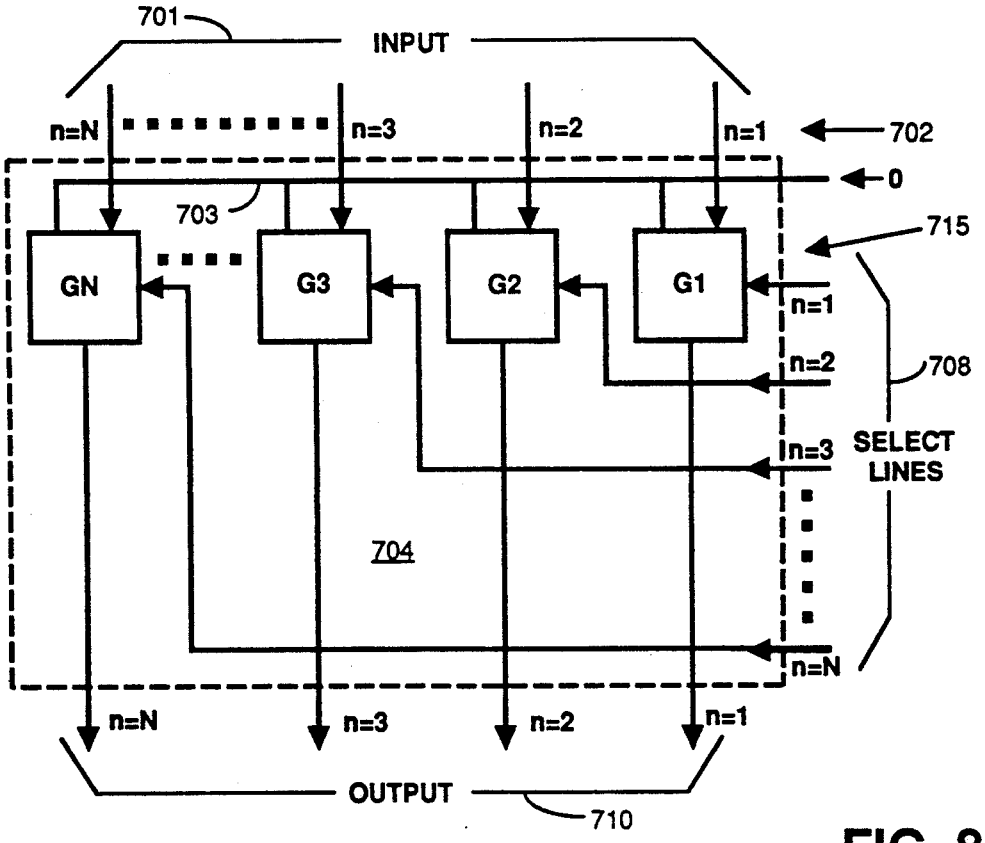
FIG. 8 is a schematic diagram showing further details of the multiplexers used in FIG. 7.

Referring now to FIG. 8, the operation of multiplexer 704 is described. The construction and operation of multiplexer 705 is similar. Multiplexer 704 is generally an N by N multiplexer having N gates 715, denoted by G1, . . . ,GN. One input to each of gates 715 is connected to input 701 to receive a particular value (identified by index n) of an input signal vector 702, and another input 703 is tied to the system logical 0 reference level, e.g., ground. Gates 715 couple output 710 to either input 701 (i.e., signal 702) or input 703 (i.e., "zero"), as determined by the logical signal present on select lines 708. For the arrangement shown, a value of 1 on, for example, line n=i of select lines 708 causes the n=i value of input vector 702 (appearing on the n=i line of input 701) to be transferred to the n=i line of output 710, otherwise a value of 0 is transferred. Any equivalent logic arrangement having an analogous result will also serve.

Multiplexer 704 is capable of receiving N input signal values 702 on input 701 and N select values on select lines 708 and transferring up to N values from input signal 702 to outputs 710 according to whether select lines 708 driven by memory 706 are set to 0 or 1. The operation of multiplexer 705 is similar with respect to inputs 702, select lines 709 driven by memory 707 and outputs 711, except that multiplexer 705 passes the values of input vector signal 702 at input 701 to output 711 for indices k, n where the codebook vector value is −1 while multiplexer 704 passes the input vector values 702 to output 710 for indices k, n where the codebook vector value is +1.

Outputs 710 and 711 are coupled to accumulators 712, 713 respectively, wherein the input vector signal values 702 transferred through multiplexers 704, 705 are added together to produce outputs 716, 717 corresponding to the $Q^+(k)$ and $Q^-(k)$ correlation values, respectively. Outputs 716, 717 are combined in combiner 720 to produce correlation output values Q(k) at 721. Where codebook 180 is a ternary codebook, as in this example, then combiner 720 takes the difference of outputs 716, 717 from accumulators 712, 713 to produce output 721, i.e., $Q(k)=Q^+(k)-Q^-(k)$. This takes into account that the operations performed by multiplexer 705, memory 707 and accumulator 713 correspond to the −1 values of codebook 180, e.g., see FIG. 10. While combiner 720 subtracts in this particular implementation, those of skill in the art will understand based on the description herein that the same result could be obtained by many other means. For example, and not intended to be limiting, the same output 721 is obtained by inverting the output of multiplexer 705 or accumulator 713 and making combiner 720 an adder.

Correlation generator 700 of FIG. 7 corresponds, for example, to correlation generators 520 or 520' of FIGS. 3–4 and output 721 of correlation generator 700 corresponds to output 521 of FIG. 3 or output 551' of FIG. 4 but for stochastic codebook vectors $S_k(n)$ rather than adaptive codebook vectors $C_k(n)$ and for target speech signal Y(n) rather than X(n), depending upon what particular input signal vector is being processed.

A further embodiment of the present invention will now be described in connection with Eq. 6" and FIGS. 6, 9, 10. Applying Eq. 6" to codebook 180' of FIG. 6 yields the correlation values Q(1) through Q(8) for values of W'(n) where n=1 to 20, as shown in Table I:

TABLE I

| | |
|---|---|
| Q(1) = | +W'(04)−W'(05)−W'(09)+W'(14)−W'(18)+W'(19) |
| Q(2) = | +W'(02)−W'(03)−W'(07)+W'(12)−W'(16)+W'(17) |
| Q(3) = | −W'(01)−W'(05)+W'(10)−W'(14)+W'(15)+W'(20) |
| Q(4) = | −W'(03)+W'(08)−W'(12)+W'(13)+W'(18)−W'(19) |
| Q(5) = | −W'(01)+W'(06)−W'(10)+W'(11)+W'(16)−W'(17) |
| Q(6) = | +W'(04)−W'(08)+W'(09)+W'(14)−W'(15)−W'(19) |
| Q(7) = | +W'(02)−W'(06)+W'(07)+W'(12)−W'(13)−W'(17) |
| Q(8) = | −W'(04)+W'(05)+W'(10)−W'(11)−W'(15)+W'(20) |

The array of Table I may be rearranged to group the terms which correspond to the +1 codebook values and the terms which correspond to the −1 codebook values so as to express the correlation values as $Q(k)=[Q^+(k)]-[Q^-(k)]$, as shown in Table II:

TABLE II

| | |
|---|---|
| Q(1) = | [W'(04)+W'(14)+W'(19)] − [W'(05)+W'(09)+W'(18)] |
| Q(2) = | [W'(02)+W'(12)+W'(17)] − [W'(03)+W'(07)+W'(16)] |
| Q(3) = | [W'(10)+W'(15)+W'(20)] − [W'(01)+W'(05)+W'(14)] |
| Q(4) = | [W'(08)+W'(13)+W'(18)] − [W'(03)+W'(12)+W'(19)] |
| Q(5) = | [W'(06)+W'(11)+W'(16)] − [W'(01)+W'(10)+W'(17)] |
| Q(6) = | [W'(04)+W'(09)+W'(14)] − [W'(08)+W'(15)+W'(19)] |
| Q(7) = | [W'(02)+W'(07)+W'(12)] − [W'(06)+W'(13)+W'(17)] |
| Q(8) = | [W'(05)+W'(10)+W'(20)] − [W'(04)+W'(11)+W'(15)] |

The values shown in the left-most brackets of Table II correspond to the input to accumulator 712 and the values in the right-most brackets of Table II correspond to the input to accumulator 713.

Referring to codebook 180' of FIG. 6, it is apparent that the codebook is sparsely populated, i.e., most of the entries are 0's. Further, referring to Tables I and II, it is apparent that the overlapping nature of the successive vectors is reflected in the indices of the values of W'(n) being summed to obtain the correlation values Q(k). Accordingly, the codebook structure lends itself to more economical ways of generating the sums indicated in Tables I and II. These are described below.

Rather than store all of the codebook values, one can store only the indices (i.e., the values of n) of the non-zero entries for each value of k. This is most conveniently accomplished separately for the $Q^+(k)$ and the $Q^-(k)$ values, but that is not essential. The correlation values $Q^+(k)$ and $Q^-(k)$ for each value of k are obtained merely by summing the W'(n) values corresponding to the stored values of n for each value of k, i.e., executing the sums shown in Tables I or II.

The computational and/or the address storage requirements can be further reduced and speedier operation obtained by using a recursive computational method that takes into account the overlapping nature of the codebook entries. With this approach, which is preferred, one stores the index values n of the codebook entries for k=1 and 30 calculates the indices n for vectors k=2, k=3, etc., from the index values of k=1 based on the codebook overlap. The indices of any new codebook entries added at the ends of each vector are also taken into account.

For example, in the case of the +1 entries in FIG. 9 and the $Q^+(k)$ portion of Table II (i.e., left-most bracketed quantities), one stores n=4, 14, 19 and the codebook overlap, in this case N−2 (i.e., $\Delta k=+1$, $\Delta n=-2$) and calculates the contribution to the Q(k)'s that come from the corresponding W'(n) values, as follows:

The k=1,n=4 index is evaluated first and contributes to the $Q^+(1)$ and $Q^+(2)$ values the terms:

TABLE III

| | |
|---|---|
| $Q^+(1)$ = | W'(04) |
| $Q^+(2)$ = | W'(02). |

The Q(2) term W'(02) for index k=2,n=2 is determined by applying the codebook overlap ($\Delta k=+1$, $\Delta n=-2$) to the first index k=1, n=4..

The k=1, n=14 index is evaluated next and contributes additional terms W'(14), W'(12), W'(10), W'(08), W'(06), W'(04), W'(04) and W'(02). All the terms except W'(14) are determined by applying the codebook overlap to the starting index k=1, n=14. The result is as follows:

TABLE IV

| | |
|---|---|
| $Q^+(1)$ = | W'(04)+W'(14) |
| $Q^+(2)$ = | W'(02)+W'(12) |
| $Q^+(3)$ = | W'(10) |
| $Q^+(4)$ = | W'(08) |
| $Q^+(5)$ = | W'(06) |
| $Q^+(6)$ = | W'(04) |
| $Q^+(7)$ = | W'(02). |

The k=1, n=19 index is evaluated next and contributes additional terms W'(19), W'(17), W'(15), W'(13), W'(11), W'(09), W'(07), W'(05), W'(03) and W'(01). All terms except the W'(19) are found by applying the codebook overlap to the starting index k=1, n=19. The result is as follows, where the sequence has been extended for vectors k>8 to show how the contribution continues for higher vector numbers:

TABLE V

| |
|---|
| $Q^+(1)$ = W'(04)+W'(14)+W'(19) |

TABLE V-continued

| |
|---|
| $Q^+(2) = W'(02)+W'(12)+W'(17)$ |
| $Q^+(3) = W'(10)+W'(15)$ |
| $Q^+(4) = W'(08)+W'(13)$ |
| $Q^+(5) = W'(06)+W'(11)$ |
| $Q^+(6) = W'(04)+W'(09)$ |
| $Q^+(7) = W'(02)+W'(07)$ |
| $Q^+(8) = W'(05)$ |
| $Q^+(9) = W'(03)$ |
| $Q^+(10) = W'(01)$. |

This exhausts the indices for $k=1$ and all of the values that can be determined therefrom based on the codebook overlap. No additional non-zero values appear at the ends of vectors $k=1$, $k=2$, so correlation values $Q+(1)$,$Q+(2)$ are now complete.

The next index to be included is $k=3$,$n=20$ and contributes additional terms W'(20), W'(18), W'(16), W'(14), W'(12), W'(10), W'(08), W'(06), W'(04) and W'(02). Again, terms except W'(20) are identified by applying the codebook overlap to the starting index $k=3$, $n=20$. The result is as follows, where the sequence has been extended for vectors $k>10$ to show how the contribution continues for higher vector numbers:

TABLE VI

| |
|---|
| $Q^+(1) = W'(04)+W'(14)+W'(19)$ |
| $Q^+(2) = W'(02)+W'(12)+W'(17)$ |
| $Q^+(3) = W'(10)+W'(15)+W'(20)$ |
| $Q^+(4) = W'(08)+W'(13)+W'(18)$ |
| $Q^+(5) = W'(06)+W'(11)+W'(16)$ |
| $Q^+(6) = W'(04)+W'(09)+W'(14)$ |
| $Q^+(7) = W'(02)+W'(07)+W'(12)$ |
| $Q^+(8) = W'(05)+W'(10)$ |
| $Q^+(9) = W'(03)+W'(08)$ |
| $Q^+(10) = W'(01)+W'(06)$ |
| $Q^+(12) = W'(04)$ |
| $Q^+(13) = W'(02)$. |

This exhausts the indices for $k=1$ through $k=7$ and all of the values that can be determined therefrom based on the codebook overlap. No additional non-zero values appear at the ends of vectors $k=1$ through $k=7$, so correlation values $Q^+(1)$ through $Q^+(7)$ are now complete.

The above-described process continues until the non-zero entries in the codebook have been exhausted and all $Q^+(k)$ correlation values have been determined. The process used for the $Q^-(k)$ values is substantially identical. Separating the ternary codebook into separate portions for calculating $Q^+(k)$ and $Q^-(k)$ avoids having to account for the sign of the individual entries during the above-described process for calculating the Q(k) correlation values taking advantage of the codebook overlap, but that is not precluded. Q(k) is found by the difference $Q(k)=Q^+(k)-Q^-(k)$. The vector of index $k=j$ having the largest correlation value Q(j) is identified by comparing the Q(k) values for $k=1$ to $k=K$ (or for at least some sub-set thereof), using means well known in the art. The correlation values determined above are used in connection with other information in the analysis-by-synthesis process previously described to identify the optimal stochastic codebook vector, that is, the stochastic codebook vector which, when used to synthesize speech, provides the least error compared to the input target speech. This optimal stochastic codebook vector from codebook 180 is then used in part to construct the VOCODE being transmitted which is eventually used to again reproduce the input speech in the receiver.

The above-described process of providing the equivalent of the sum of the products of a first vector having $n=1$ to N values by a set of $k=1$ to K second vectors having $n=1$ to N values by taking advantage of the sparse non-zero values of the codebook and the overlapping nature of the codebook vectors results in substantially reduced computational burden compared to the prior art and may be accomplished more quickly and with substantially less computational resources than required by prior art. The above-described process is conveniently accomplished on a general purpose computer or a special purpose computer, programmed to execute the procedures described herein and illustrated in Tables I–VI. Persons of skill in the art will understand based on the description herein and using means well known in the art, how to program a computer to accomplish the above-described steps.

It will be apparent to those of skill in the art based on the description herein that the above-described means and method produces the same effect as the multiplication steps normally required for the cross-correlation process associated with determining which of the stochaatic codebook vectors provides the best match with the target speech. By eliminating the multiply operation, the correlation operation is made faster and the required number of manipulations of the vector values is reduced. These benefits are highly advantageous.

Finally, the above-described embodiments of the invention are intended to be illustrative only. Numerous alternative embodiments may be devised without departing from the spirit and scope of the following claims.

What is claimed is:

1. A method for CELP coding speech by combining a first vector with a set of second vectors identified by index k, wherein the first and second vectors have values identified by indices n running from $n=1$ to N, comprising:

providing an N by N multiplexer having $n=1$ to N outputs, $n=1$ to N first inputs, second inputs, and $n=1$ to N select means, wherein a first logic level presented to $n^{th}$ select means couples the $n^{th}$ output to the $n^{th}$ first input and a second logic level presented to the $n^{th}$ select means couples the $n^{th}$ output to the second input;

supplying $n=1$ to N values of the first vector to the $n=1$ to N first inputs of the multiplexer;

presenting $n=1$ to N values of the second vector of index $k=1$ to $n=1$ to N select means of the multiplexer, the second vector providing at the $n=1$ to N select means the first logic level for some values of n and the second logic level for other values of n;

adding together values of the first vector coupled to the multiplexer output to provide a sum;

repeating the presenting and adding steps for further values of k; and synthesizing speech based on whichever sum identifies a second vector giving the closest match to target speech.

2. The method of claim 1 further comprising determining which vector $k=j$ has the largest sum.

3. The method of claim 1 wherein the supplying, presenting and adding steps are repeated for other first vectors.

4. A method for CELP coding speech by combining a first vector with a set of second vectors identified by index k, wherein the first and second vectors have values identified by indices n running from n=1 to N, comprising:

dividing each second vector into two portion, a first portion having values 0, +1 corresponding to the location of values of 0, +1 of the second vector and a second portion having values 0, +1 corresponding to the location of values 0, −1 of the second vector, comprising:

providing first and second N by N multiplexers each having n=1 to N outputs, n=1 to N first inputs, second inputs, and n=1 to N select means, wherein a first logic level presented to $n^{th}$ select means couples the $n^{th}$ output to the $n^{th}$ first input and a second logic level presented to the $n^{th}$ select means couples the $n^{th}$ output to the second input;

supplying n=1 to N values of the first vector to the n=1 to N first inputs of the first and second multiplexers;

presenting n=1 to N values of the k=1 first portion of the second vector to n=1 to N select means of the first multiplexer and presenting the n=1 to N values of the k=1 second portion of the second vector to n=1 to N select means of the second multiplexer;

adding together values of the first vector coupled to the output of the first multiplexer to provide a first sum and adding together values of the first vector at the output of the second multiplexer to provide a second sum;

combining the first and second sums to provide a result;

repeating the presenting, adding and combining steps for further values of k; and synthesizing speech based on whichever result identifies a second vector giving the closest match to target speech.

5. The method of claim 4 further comprising comparing the results for each value of k to determine the value of k having the largest result.

6. The method of claim 4 wherein the supplying, presenting, adding and combining steps are repeated for other first vectors.

7. An apparatus for CELP coding speech by combining a first vector with a set of second vectors identified by an index k, wherein the first and second vectors have values identified by indices n running from n=1 to N, comprising:

an N by N multiplexer having n=1 to N outputs, n=1 to N first inputs, second inputs, and n=1 to N select means, wherein a first logic level presented to $n^{th}$ select means couples the $n^{th}$ output to the $n^{th}$ first input and a second logic level presented to the $n^{th}$ select means couples the $n^{th}$ output to the second input;

means for supplying n=1 to N values of the first vector to the n=1 to N first inputs of the multiplexer;

means for presenting n=1 to N values of the second vector of index k=1 to the n=1 to N select means of the multiplexer, the second vector providing at the n=1 to N select means the first logic level for some values of n and the second logic level for other values of n;

means coupled to the multiplexer output for adding together values of the first vector transferred to the outputs of the multiplexer to provide a sum;

means for indexing k from k=1 to k=K; and means for synthesizing speech based on whichever sum identifies a second vector giving the closest match to target speech.

8. The apparatus of claim 7 further comprising means for determining which vector k=j has the largest sum.

9. The apparatus of claim 7 further comprising means for supplying other first vectors.

10. An apparatus for CELP coding speech by combining a first vector with a set of second vectors identified by index k and having values identified by indices n=1 to N, comprising:

memory means for storing first portions of the second vectors, and having values 0, +1 corresponding to the locations of values 0, +1 of the second vectors;

memory means for storing second portions of the second vectors, and having values 0, +1 corresponding to the locations of values 0, −1 of the second vectors, comprising:

first and second N by N multiplexers each having n=1 to N outputs, n=1 to N first inputs, second inputs, and n=1 to N select means, wherein a +1 presented to $n^{th}$ select means couples the $n^{th}$ output to the $n^{th}$ first input and a 0 presented to the $n^{th}$ select means couples the $n^{th}$ output to the second input, the first multiplexer coupled to the first memory means and the second multiplexer coupled to the second memory means;

means for supplying n=1 to N values of the first vector to the n=1 to N first inputs of the first and second multiplexers;

means for presenting n=1 to N values of the k=1 first portion of the second vector to n=1 to N select means of the first multiplexer;

means for presenting the n=1 to N values of the k=1 second portion of the second vector to n=1 to N select means of the second multiplexer;

first adder coupled to the outputs of the first multiplexer for summing values of the first vector appearing at outputs of the first multiplexer to produce a first sum;

second adder coupled to the outputs of the second multiplexer for summing values of the first vector appearing at outputs of the second multiplexer to produce a second sum;

means for combining the first and second sums to produce a result;

means for indexing k to load first and second portions of other second vectors into the memory means and for multiplexing, adding and combining to produce other results; and means for synthesizing speech based on whichever result identifies a second vector giving the closest match to target speech.

11. The apparatus of claim 10 further comprising means for comparing the results for each value of k to determine the value of k having the largest result.

12. The apparatus of claim 10 further comprising means for providing other first vectors.

13. A method for CELP coding speech using a combination of a first vector V(n) having values identified by index n running from n=1 to N, and a set of the second vectors $S_k(n)$ wherein each of the second vectors is identified by index k and wherein each of the second vectors has up to N values which are either zero or non-zero and are identified by index n from n=1 to N, comprising:

identifying indices $n_{k,i}$ of $S_k(n)$ for different k wherein $S_k(n_i)$ are non-zero;

adding values of the V(n) corresponding to indices $n_{k,i}$ to form sums Q(k);

identifying the value k=j corresponding to the largest value Q(k=j); and synthesizing.speech using $S_k=j(n)$.

14. The method of claim 13 wherein successive vectors of the set of second vectors are determined by overlap of the preceding second vector according to an overlap amount Δk,Δn, wherein the identifying and adding steps comprise:

identifying for k=1 indices $n_{1,i}$ of $S_k(n)$ wherein $S_1(n_i)$ are non-zero:

starting from $n_{1,i}$ and using the overlap amount Δk,Δn, determining further indices $n_{k,i'}$ for k>1 wherein $S_k(n_{i'})$ are non-zero; and adding values of the V(n) for such indices and further indices to form sums Q(k).

15. The method of claim 14 further comprising identifying for k≧2, a first index $n_{k,i''}$ not previously identified wherein $S_k(n_{i''})$ is non-zero, and then, starting from index $n_{k,i''}$ determining still further indices $n_{k,i'''}$ for k≧3 wherein $S_k(n_{i'''})$ are non-zero using the overlap amount, and adding values of v(n) for such still further indices to further form sums Q(k).

16. An apparatus for CELP coding speech using a combination of a first vector V(n) having values identified by index n running from n=1 to N, and a set of the second vectors $S_k(n)$ wherein each of the second vectors is identified by index k and wherein each of the second vectors has up to N values which are either zero or non-zero and are identified by index n from n=1 to N, comprising:

means for identifying indices $n_{k,i}$ of $S_k(n)$ for different k wherein $S_k(n_i)$ are non-zero;

means for adding values of the V(n) corresponding to indices $n_{k,i}$ to form sums Q(k);

means for identifying the value k=j corresponding to the largest value Q(k=j); and means for synthesizing.speech using $S_k=j(n)$.

17. The apparatus of claim 16 wherein successive vectors of the set of second vectors are determined by overlap of the preceding second vector according to an overlap amount Δk,Δn, wherein the means for identifying and adding comprise:

means for identifying for k=1 indices $n_{1,i}$ of $S_k(n)$ wherein $S_1(n_i)$ are non-zero:

means for determining further indices $n_{k,i'}$ for k>1 wherein $S_k(n_i)$ are non-zero, starting from $n_{1,i}$ and using the overlap amount Δk,Δn; and means for adding values of the V(n) for such indices and further indices to form sums Q(k).

18. The apparatus of claim 17 wherein the means for identifying, determining and adding comprise, means for identifying for k≧2, a first index $n_{k,i''}$ not previously identified wherein $S_k(n_{i''})$ is non-zero, means for determining still further indices $n_{k,i'''}$ for k≧3 wherein $S_k(n_{i'''})$ are non-zero starting from index $n_{k,i''}$ and using the overlap amount, and means for adding values of V(n) for such still further indices to further form sums Q(k).

* * * * *